US006648362B1

(12) United States Patent
Bünter

(10) Patent No.: US 6,648,362 B1
(45) Date of Patent: Nov. 18, 2003

(54) SKI GUIDE PRESSURE INTENSIFIER PLATE (SNOW-SPEED)

(76) Inventor: Roland Bünter, Ulmenweg 3b, CH-8856 Tuggen (CH)

( * ) Notice: Subject to any disclaimer, the term of this patent is extended or adjusted under 35 U.S.C. 154(b) by 45 days.

(21) Appl. No.: 09/914,275

(22) PCT Filed: Aug. 24, 2001

(86) PCT No.: PCT/CH00/00097

§ 371 (c)(1),
(2), (4) Date: Jan. 15, 2002

(87) PCT Pub. No.: WO00/50128

PCT Pub. Date: Aug. 31, 2000

(30) Foreign Application Priority Data

Feb. 24, 1999 (EP) ..... 99103597

(51) Int. Cl.[7] ..... A63C 5/07

(52) U.S. Cl. ..... 280/602; 280/607; 280/613; 280/618

(58) Field of Search ..... 280/602, 607, 280/11.14, 11.15, 611, 613, 616, 617, 618, 623, 626, 628, 629, 633, 634, 636

(56) References Cited

U.S. PATENT DOCUMENTS

| | | | | | |
|---|---|---|---|---|---|
| 3,260,532 | A | * | 7/1966 | Heuvel | 280/602 |
| 3,797,839 | A | * | 3/1974 | Smolka et al. | 280/617 |
| 3,797,844 | A | * | 3/1974 | Smolka et al. | 280/617 |
| 4,139,214 | A | * | 2/1979 | Meyer | 280/607 |
| 4,141,570 | A | * | 2/1979 | Sudmeier | 280/607 |
| 4,269,431 | A | * | 5/1981 | Weigl | 280/618 |
| 4,294,460 | A | * | 10/1981 | Kirsch | 280/607 |
| 4,353,575 | A | * | 10/1982 | Brice | 280/614 |
| 4,526,397 | A | * | 7/1985 | Richert | 280/612 |
| 4,565,386 | A | * | 1/1986 | Crainich | 280/602 |
| 4,804,200 | A | * | 2/1989 | Kuchler | 280/602 |
| 4,934,669 | A | * | 6/1990 | Bourdeau et al. | 267/122 |
| 5,046,751 | A | * | 9/1991 | Scherubl | 280/607 |
| 5,129,668 | A | * | 7/1992 | Hecht | 280/607 |
| 5,269,555 | A | * | 12/1993 | Ruffinengo | 280/602 |
| 5,326,126 | A | * | 7/1994 | Ruffinengo | 280/602 |
| 5,332,253 | A | * | 7/1994 | Couderc et al. | 280/602 |
| 5,395,132 | A | * | 3/1995 | Abondance et al. | 280/607 |
| 5,397,149 | A | * | 3/1995 | Couderc et al. | 280/602 |
| 5,437,468 | A | * | 8/1995 | Schenner | 280/602 |
| 5,513,872 | A | * | 5/1996 | Arduin et al. | 280/602 |
| 5,540,458 | A | * | 7/1996 | Arduin et al. | 280/602 |
| 5,566,966 | A | * | 10/1996 | Couderc et al. | 280/602 |
| 5,647,605 | A | * | 7/1997 | Arduin | 280/602 |
| 5,671,939 | A | * | 9/1997 | Pineau | 280/602 |
| 5,845,923 | A | * | 12/1998 | Zanco | 280/607 |
| 5,915,719 | A | * | 6/1999 | Bauvois | 280/607 |
| 6,158,747 | A | * | 12/2000 | Magnani | 280/11.14 |

FOREIGN PATENT DOCUMENTS

| | | | | |
|---|---|---|---|---|
| CH | WO 95/00217 | * | 1/1995 | 280/607 |
| CH | WO 99/07450 | * | 2/1999 | 280/607 |

* cited by examiner

*Primary Examiner*—Brian L. Johnson
*Assistant Examiner*—Bridget Avery
(74) *Attorney, Agent, or Firm*—Pauley Petersen & Erickson

(57) ABSTRACT

A ski binding assembly plate which can be fixed or can be adjusted in forward inclination and height wherein the pressure on the front guide part of the ski is increased. Because the ski binding assembly plate is fastened on the ski with a two-point support and arrest system, the ski obtains a free bending moment, by which means the ski is dynamic and runs very smoothly. A wedge function and a force transmission system prevent the ski from being propelled back by the counter pressure in the region of the ski binding. With a damping system, vibrations and knocks are absorbed. The plate may be equipped with any brand of ski binding. It fits each type or brand of ski. The individual adjusting possibility of this plate permits the adaptation, which suits each ski, each skiing style and each technical level of the skier.

35 Claims, 36 Drawing Sheets

Ski guide pressure intensifier plate (Snow-Speed)

FIG. 1 Ski guide pressure intensifier plate (Snow-Speed)

Arrangement of the functions 2-point support and arrest system

Height adjustment h1 = normal height without Snow-Speed
h2 = additional height by way of Snow-Speed
Sp = centre of gravity/weight
L = length Lever principle: h1 + h2 × weight = length × pressure Inclination angle adjustment @ = inclination angle up to approx. 20 degrees forward
Sp1 = centre of gravity without inclination angle
Sp2 = centre of gravity with inclination angle
R = resulting pressure displacement FIG. 6
Damping system
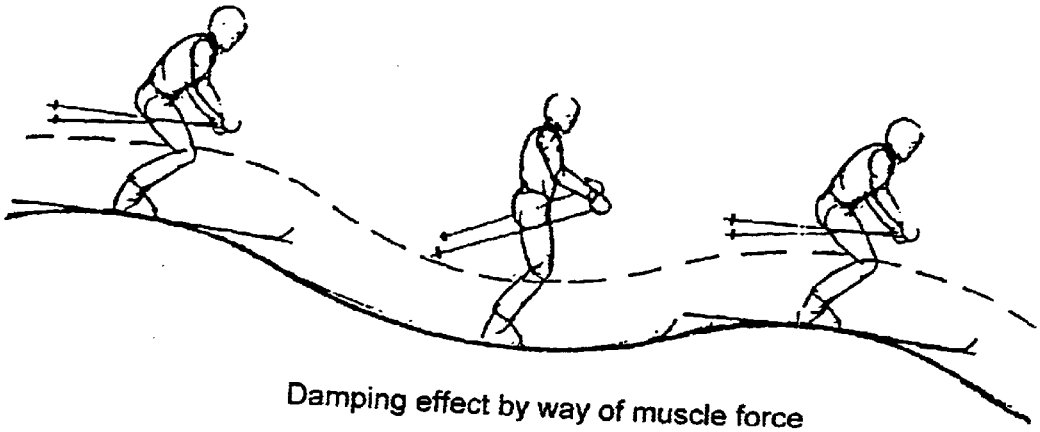
Damping effect by way of muscle force
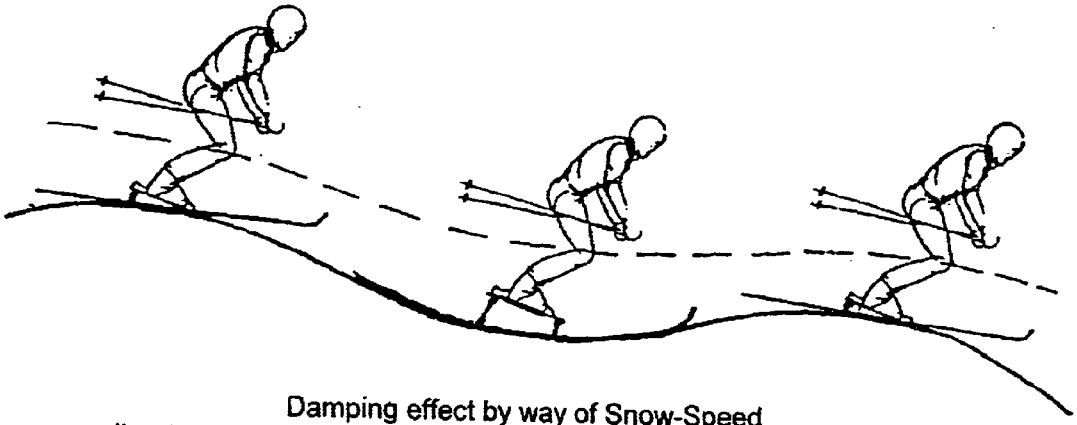
Damping effect by way of Snow-Speed
permits with less muscle effort a more favourable path of the centre of gravity Height adjustment with bolts Height adjustment with thread Height adjustment by way of thread Height adjustment with thread
(by way of rotation knob)

FIG. 15
Height adjustment with thread by way of rotation knob
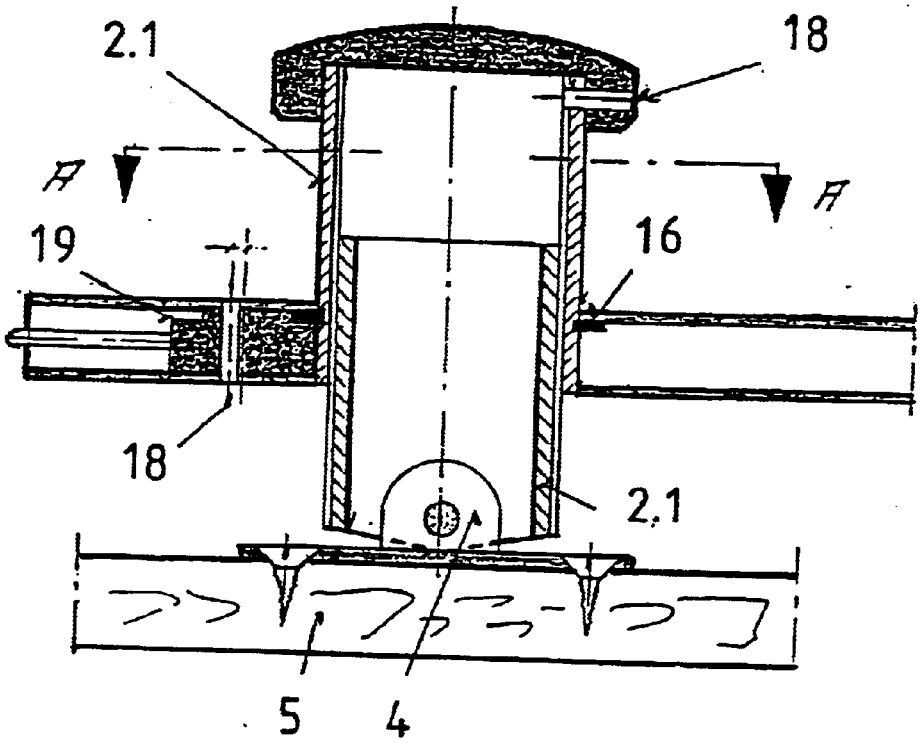
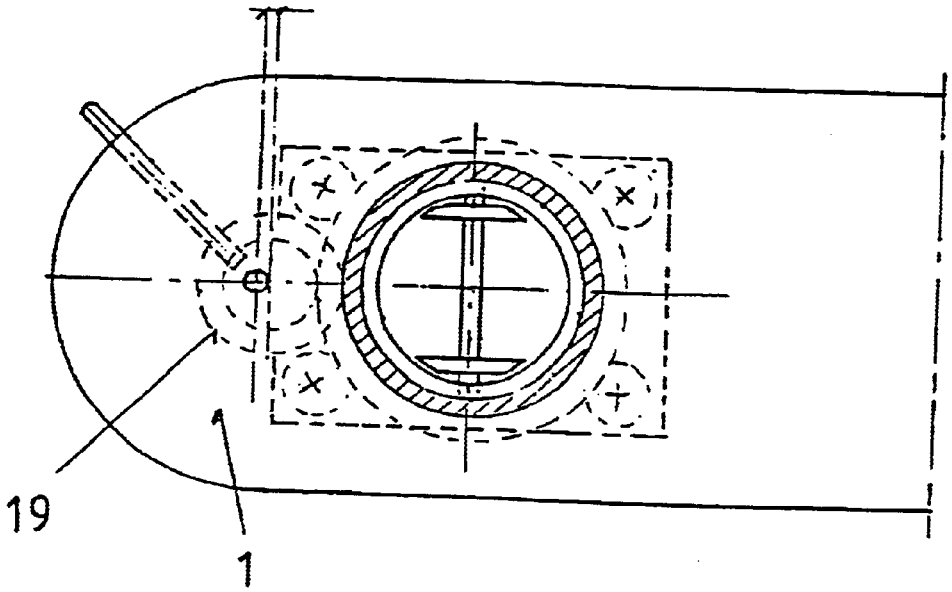
Section A-A Height adjustment by way of hinges FIG. 17 Damping effect by way of spring and air cylinder Damping effect by way of leg springs and hinges or compression springs Damping effect by way of compression springs and air cylinder FIG. 20
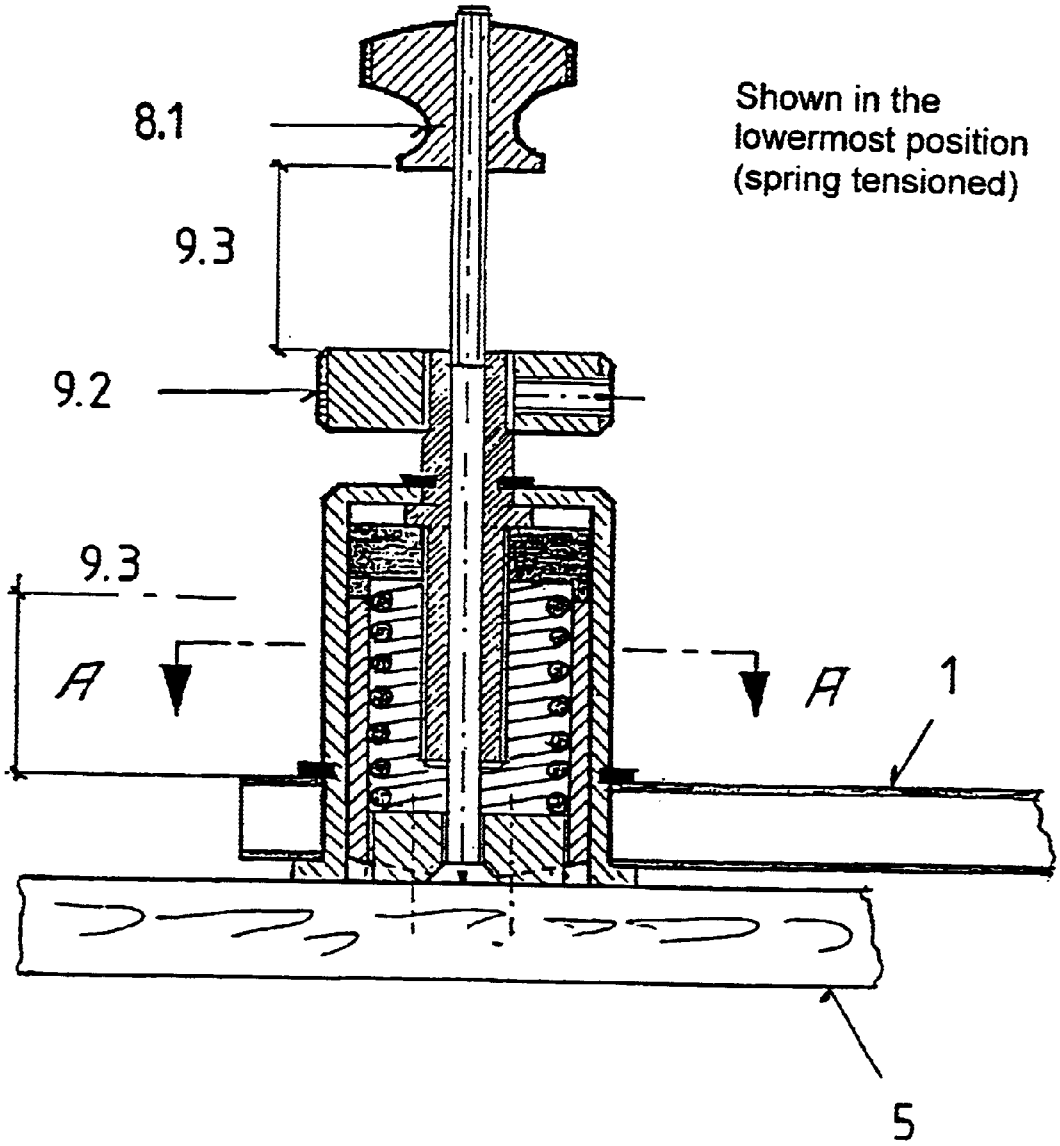
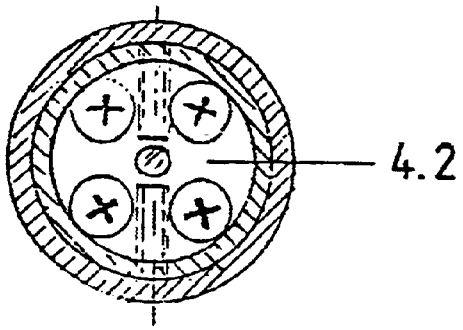
Section A-A FIG. 24
Fastening on the ski
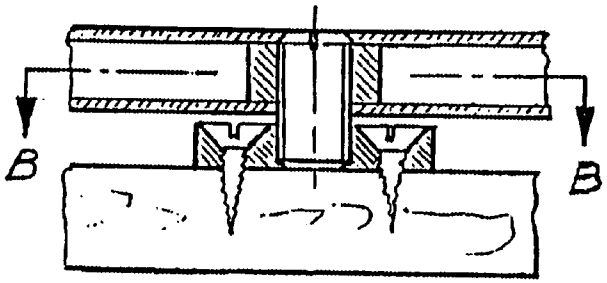
Section B-B
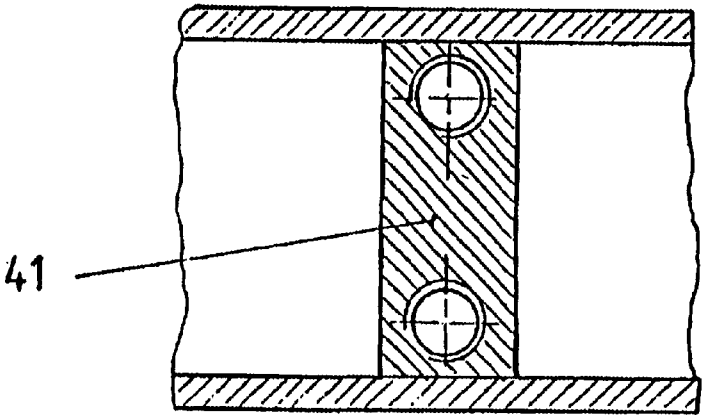
With plastic screws
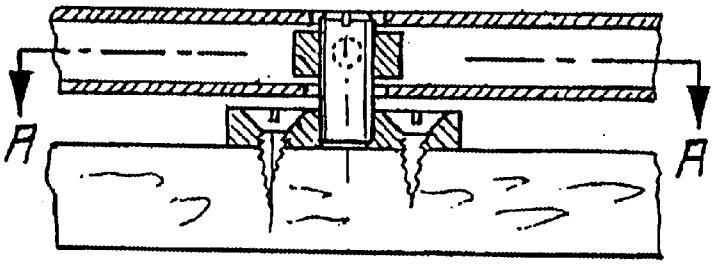
Section A-A
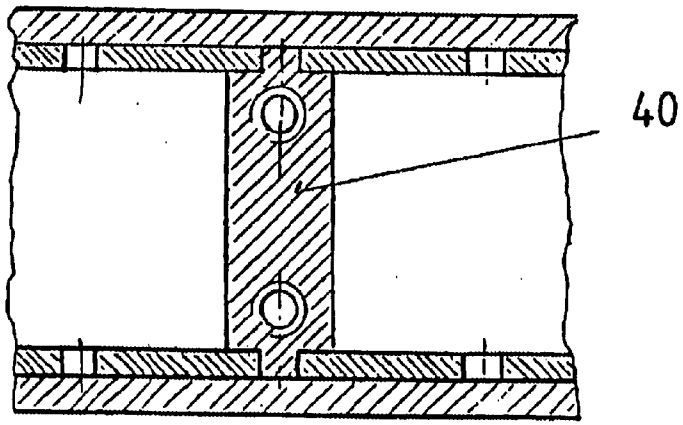
With steel screws Force transmission function

T3 T4 T5 T7

Force compensation according to the lever principle

SKI GUIDE PRESSURE INTENSIFIER PLATE (SNOW-SPEED)

BACKGROUND OF THE INVENTION

This invention relates to a ski binding assembly plate which can be fixed or can be adjusted in forward inclination and height, for increasing the pressure on the front guide part of the ski. This gives the ski a certain aggressiveness. Because the ski binding assembly plate is fastened on the ski with a two-point support and arrest system, the ski obtains a free bending moment, and thus the ski is dynamic and runs very smoothly. A wedge function and a force transmission system prevent the ski from being propelled back by the counter pressure in the region of the ski binding. These systems also dampen vibrations of the ski. Thus the ski has a biting grip on hard snow. A damping system absorbs vibrations and knocks. The plate may be equipped with any brand of ski binding and the plate fits each type or brand of ski. The individual adjusting of this plate permits the adaptation, which suits each ski, each skiing style and each technical level of the skier.

SUMMARY OF THE INVENTION

The ski binding assembly plate is manufactured in various embodiments. Various light metal or plastic profiles or profiles of other materials (rectangular tube, U-profile, C-profile) are used which may be adhered above and below as a reinforcement to a steel plate, plastic plate or other materials. Another possibility lies in that one uses cast molds which permits a construction type in which the aesthetics and the design may be enhanced.

BRIEF DESCRIPTION OF DRAWINGS

FIG. 6 is a diagrammatic view showing damping effects;

FIG. 15 shows a side sectional view and a top sectional view of a height adjustment with thread;

FIG. 20 shows a sectional view of a damping effect by way of compression springs and air cylinder, in a lowermost position, and a top sectional view of the damping effect;

FIG. 24 shows a side sectional view, a top sectional view, a front sectional view, and a second top sectional view of a fastening on the ski;

DESCRIPTION OF PREFERRED EMBODIMENTS

Different embodiments and different details of elements of the ski binding assembly plate of this invention are described in the following specification.

Figure 7:
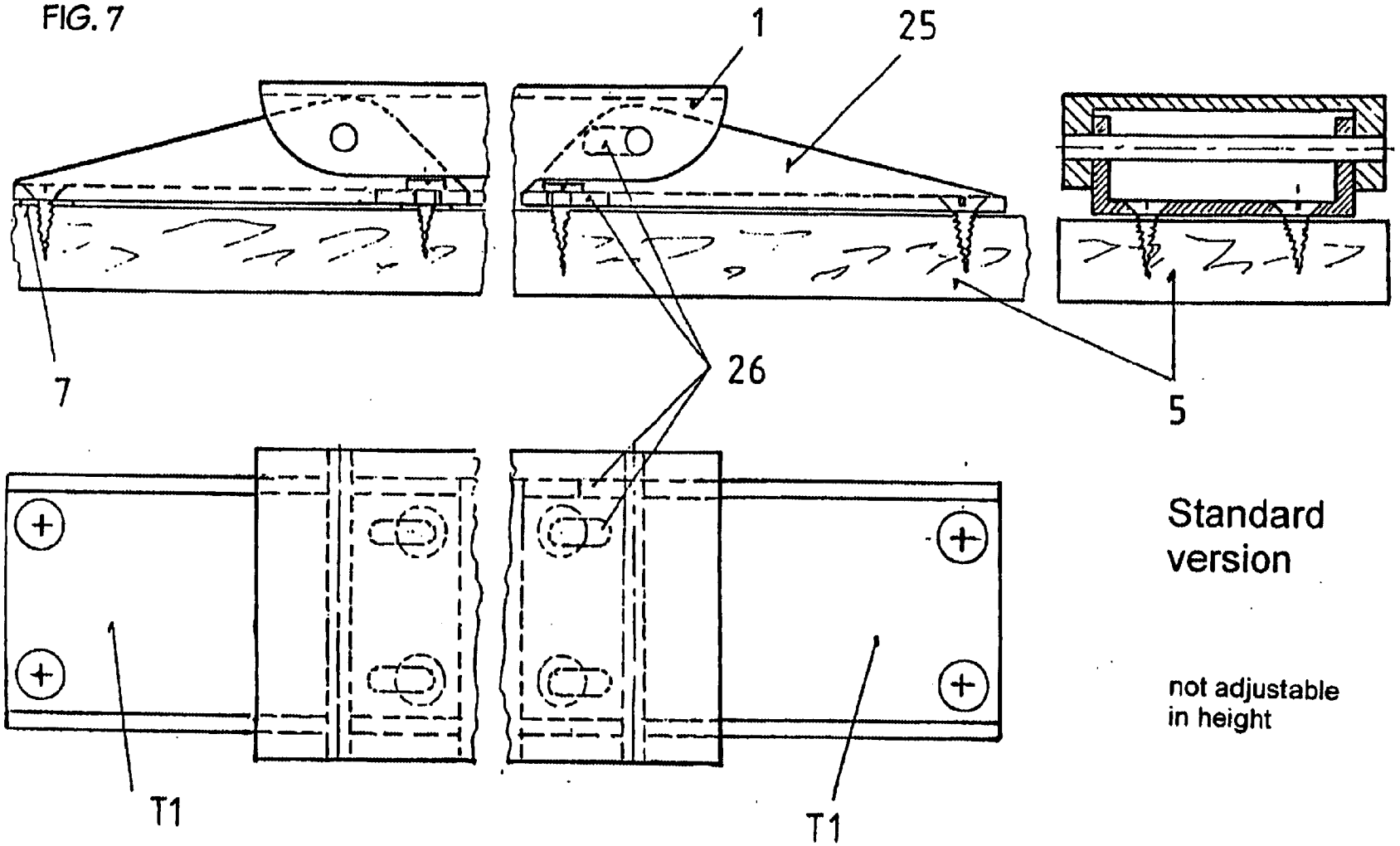
FIG. 7 shows a side view, a front partial sectional view and a top view of a pressure intensifier plate according to one embodiment of this invention.
Figure 8:
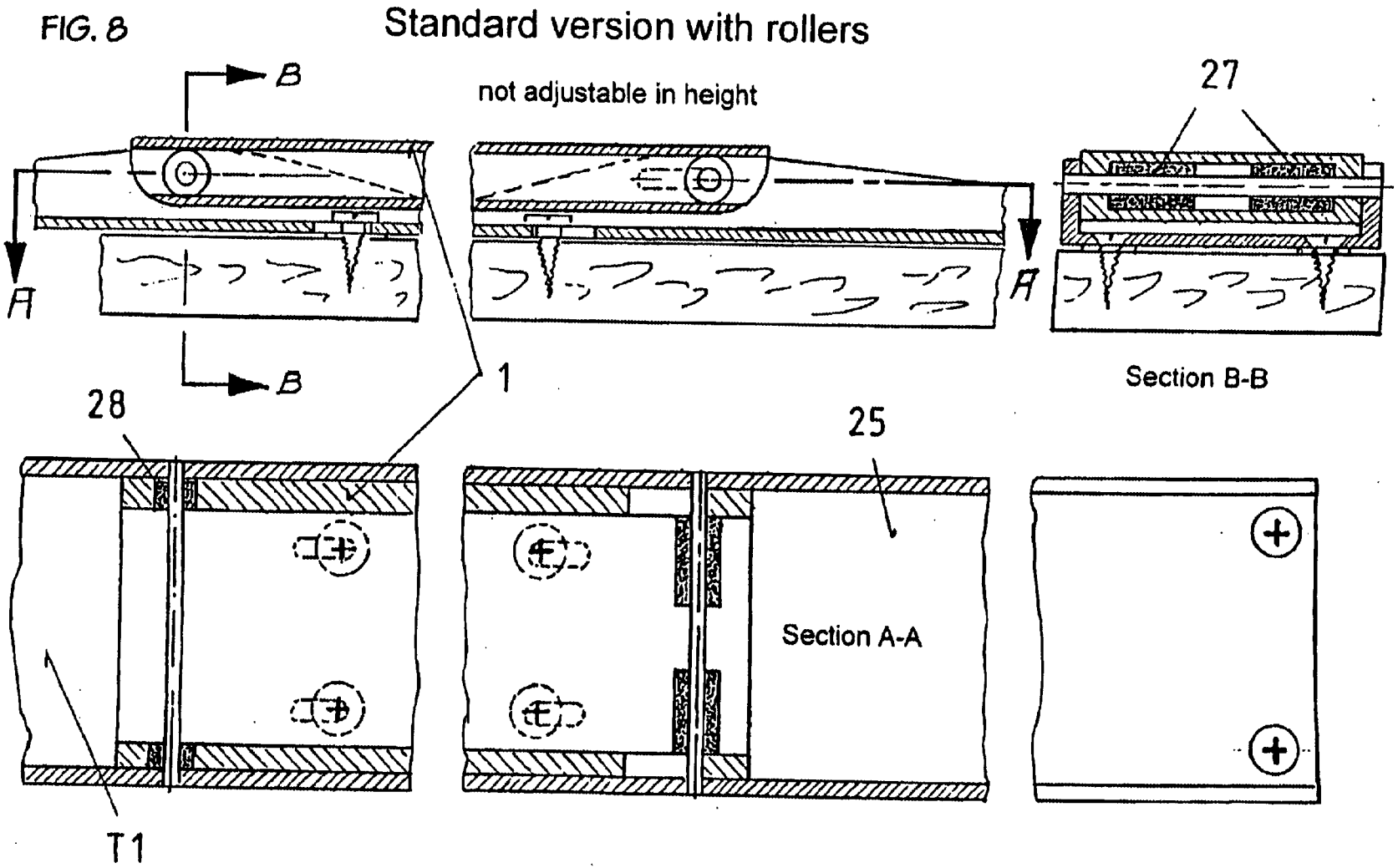
FIG. 8 shows a side partial sectional view, a front sectional view and a top sectional view of a pressure intensifier plate according to one embodiment of this invention.

Standard Design (see FIGS. 7, 8)

This embodiment may not be adjusted in height and in inclination. It is manufactured according to use. In the world cup at present there is prescribed a 5.5 cm height from the lower edge of the ski to the lower edge of the ski shoe. For the carving region a higher version is considered. It is equipped with a two-point support and arrest system and a force compensation system. Additionally it may be equipped with a damping system. It is equipped with or without length compensation rollers.

Figure 1:
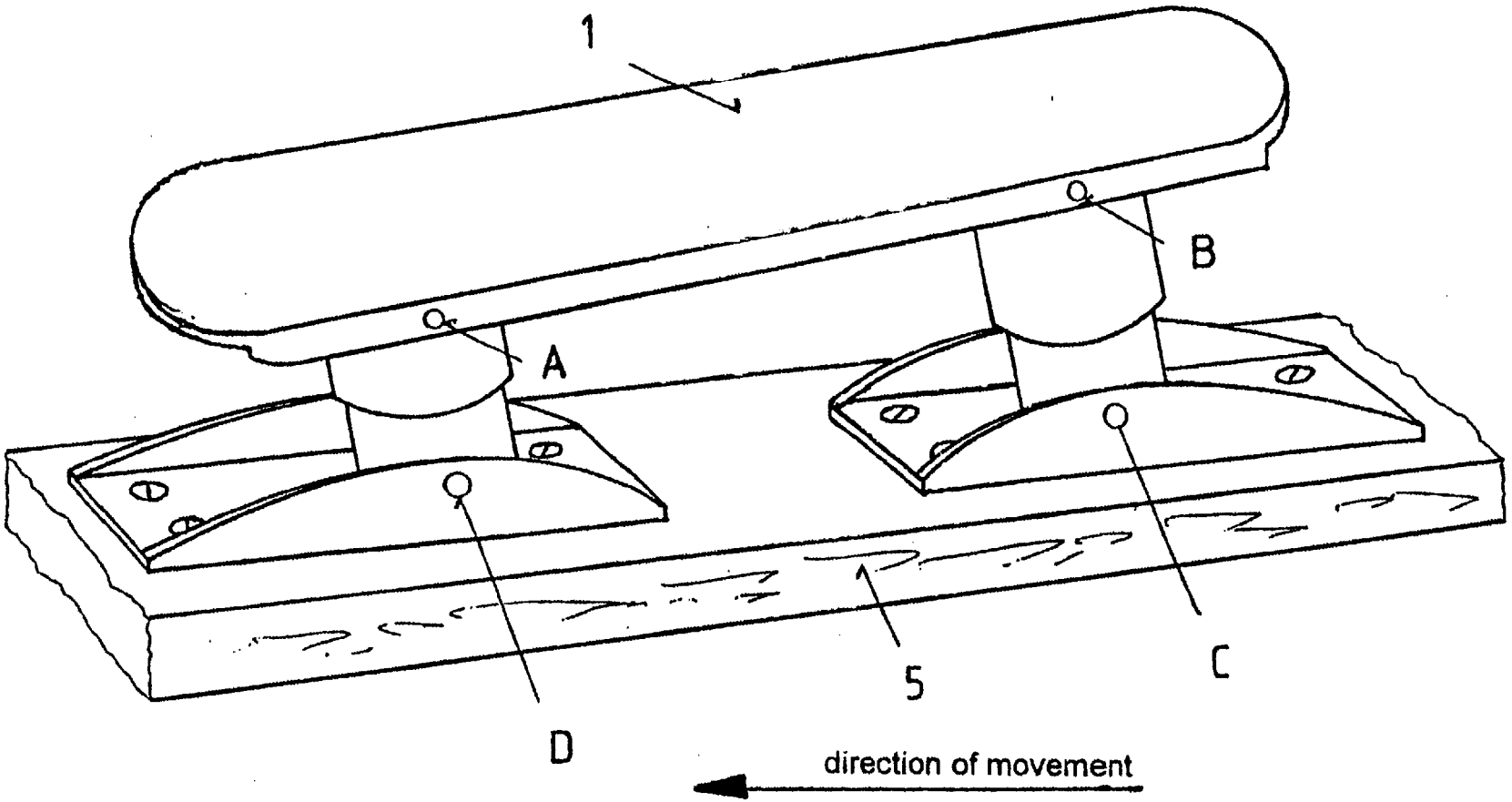
FIG. 1 is a perspective view of a ski guide pressure intensifier plate (Snow Speed)
Figure 2:
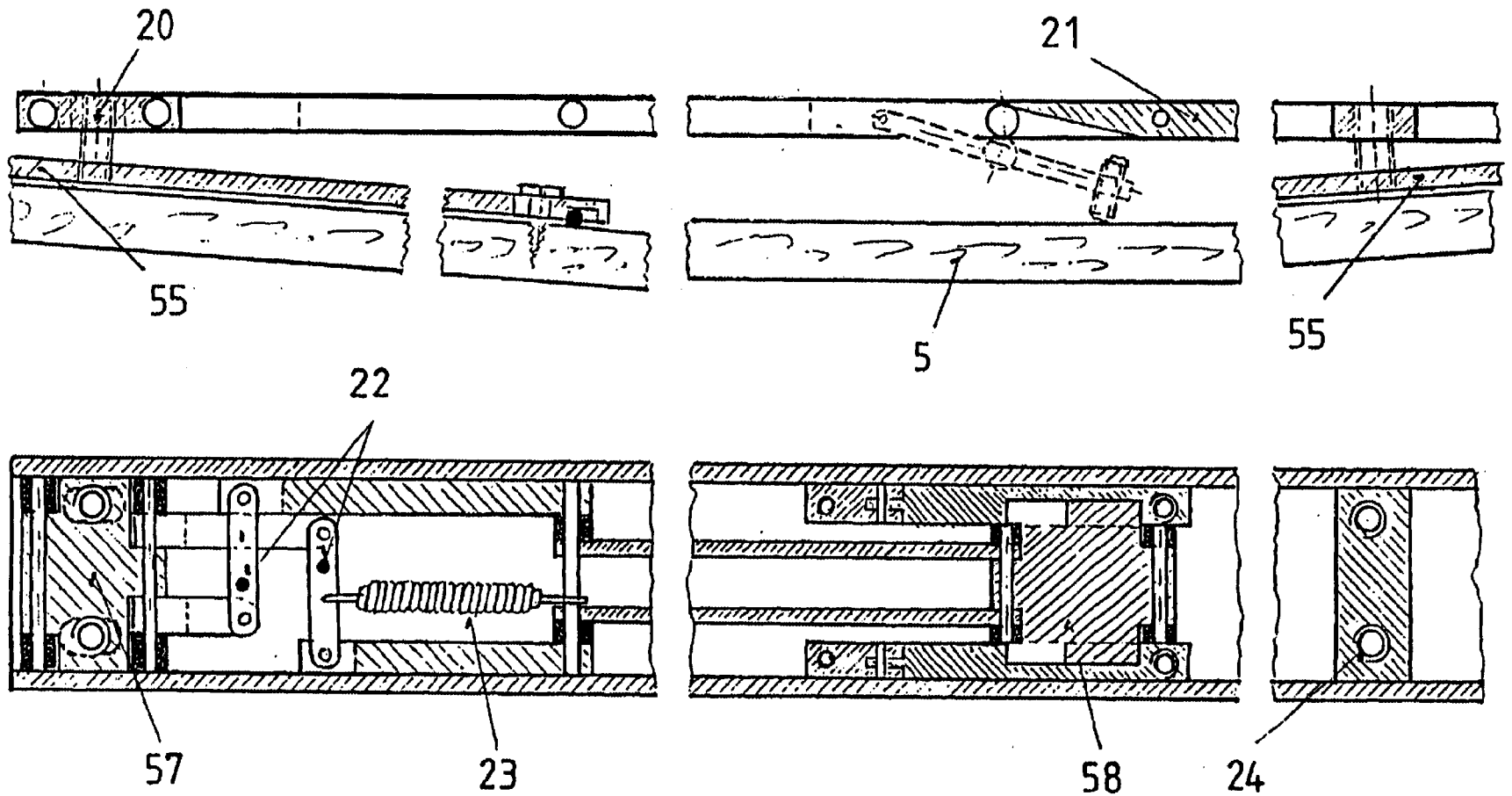
FIG. 2 shows a partial side sectional view and a top sectional view of a ski guide pressure intensifier plate.

Adjustable Embodiment (see FIGS. 1, 2)

This embodiment may be adjusted in height, in inclination and in length. It has a two-point support and arrest system, and according to use may be supplemented with a force transition system or a wedge function or in combination with both systems with a damping system.

Figure 9:
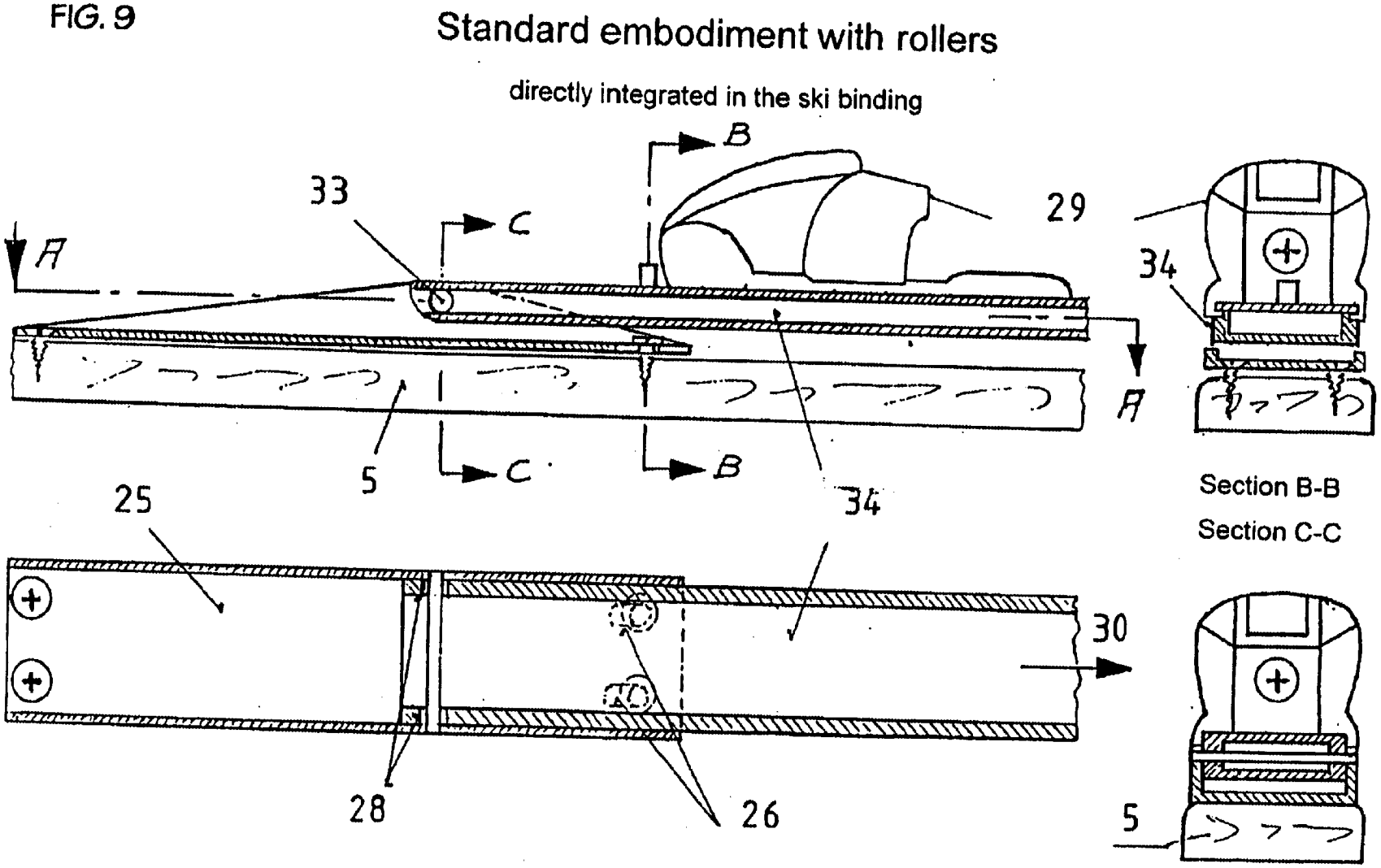
FIG. 9 shows a side partial sectional view, a first front sectional view, a top sectional view and a second front sectional view of a pressure intensifier plate, according to one embodiment of this invention.
Figure 10:
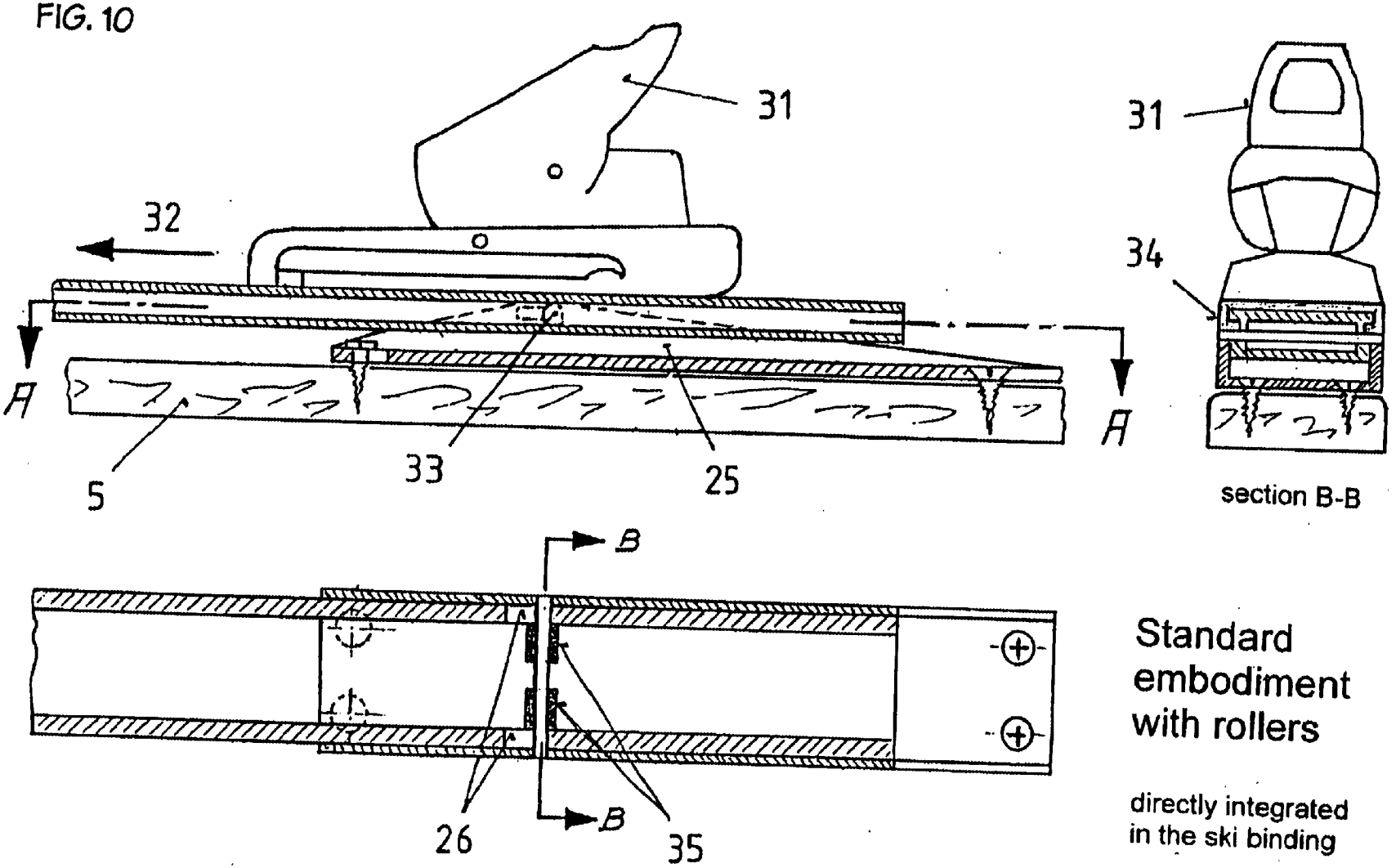
FIG. 10 shows a side partial sectional view, a front partial sectional view and a top sectional view of a pressure intensifier plate, according to one embodiment of this invention.

Embodiment Integrated In The Ski Binding (see FIGS. 9, 10)

This embodiment is the same as the standard embodiment or the adjustable embodiment, however it is integrated directly into the ski binding. The ski binding assembly plate is simultaneously the guide rail for the adjustment of the ski binding.

Embodiment In One Piece

This embodiment is the same as the standard embodiment or the adjustable embodiment, or the embodiment integrated in the ski binding. It is however manufactured of one piece. With this the fastening on the ski and on the ski binding assembly plate may be transmitted with plastic screws, also the whole device may be manufactured of plastic or of other materials from one piece. It is not intended that the ski binding assembly plate does not have several components such as for example height adjusting screws, length compensation carriage, etc., but rather it and the arrest parts on the ski is of a plastic cast part or a cast part of other materials.

Embodiment For Snowboards

This embodiment is the same as the standard embodiment or the adjustable embodiment, however is adapted to the width of the snowboard.

Figure 3:
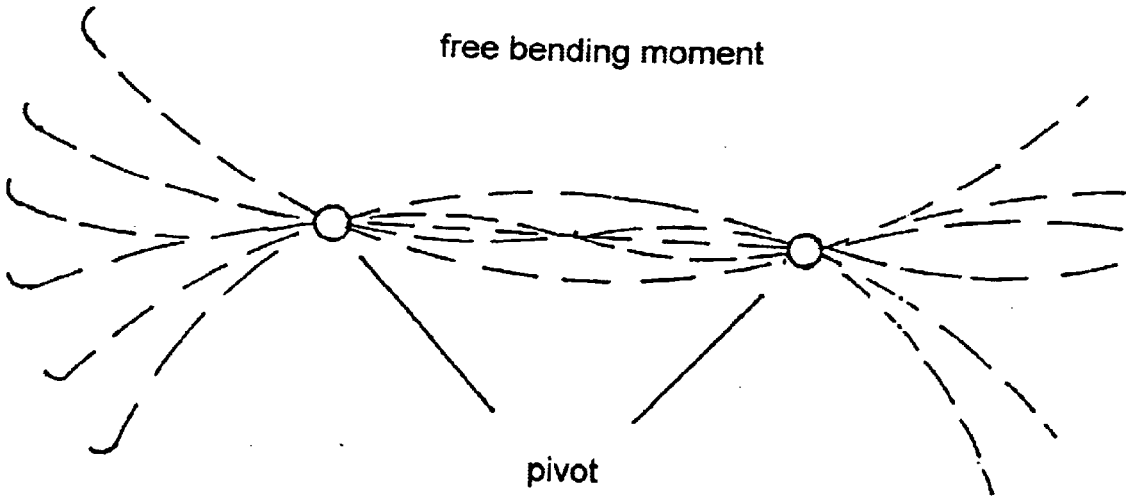
FIG. 3 shows a diagrammatic view of a bending moment diagram for a 2-point support and arrest system.

1. Two-Point Support And Arrest System (see FIG. 3)

The two point support and arrest system gives the ski a free bending moment. This means that the ski can on its whole length, also in the region of the binding, freely deflect. "Two-point" indicates the support at the front and rear on the ski at which the ski binding assembly plate is fastened by way of a length compensation carriage and via a rigid fastening, and does not indicate the assembly points of the plate, the number of which may be varied according to the construction type.

Figure 33:
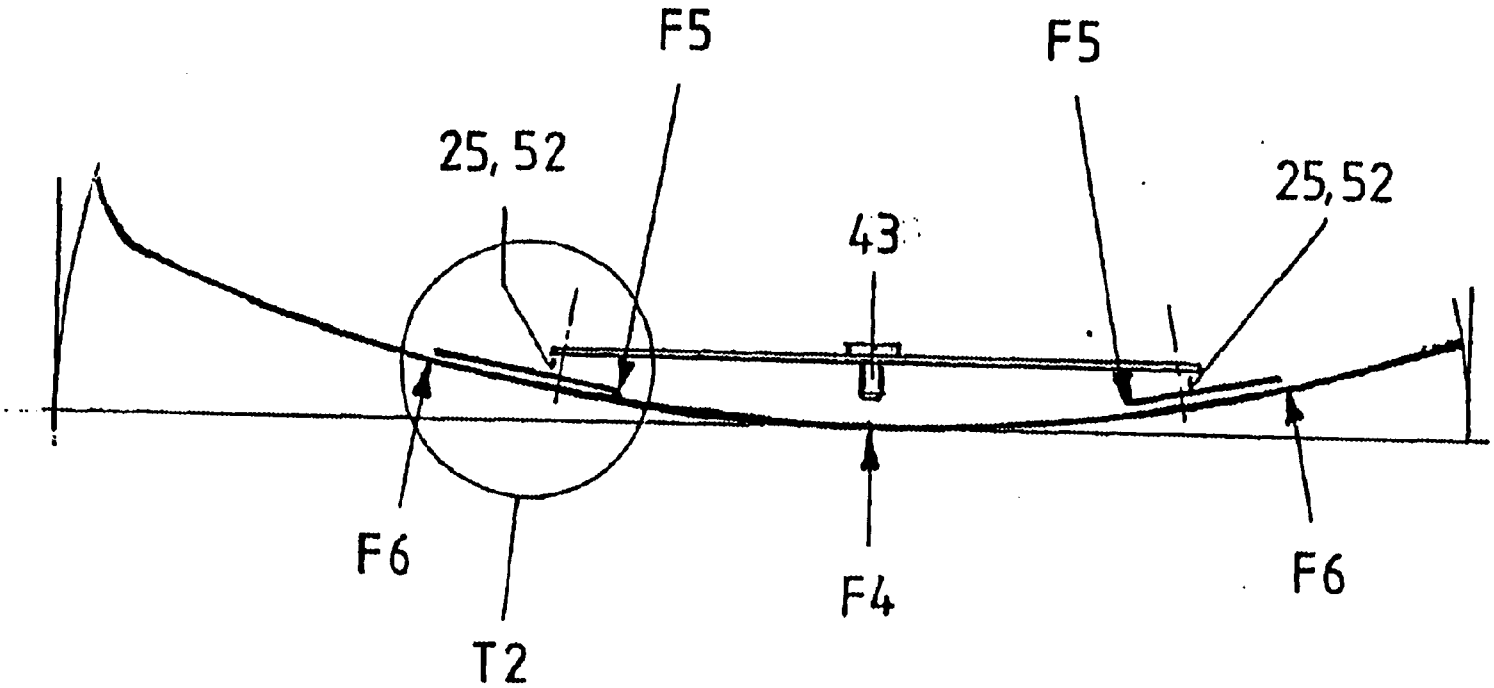
FIG. 33 shows a schematic diagram of a forced transmission function.

1.1 Length Compensation (see FIG. 33, force transmission function)

By way of the force action F6 at the rear and the back on the ski according to the curve the ski obtains a bending moment. This requires a length compensation of up to 8 mm with respect to the ski binding assembly plate. This length compensation is ensured in two ways.

Construction Type THP (Tubes, Hinges Or Pantograph) (see FIG. 1)

This construction type is constructed with rods or hinges of light metal or plastic or other materials in that a fixed point (D) and three pivots (A,B,C) are applied. The pivots (A,B,C) permit a length compensation. The fixed point (D) serves for fixing the ski binding assembly plate. The fixed point may be defined at any point (A,B,C,D) according to use.

Construction Type LCC (Length Compensation Carriage) (see FIG. 2)

The construction type is governed by the application of a length compensation carriage which is applied in the ski binding assembly plate according to the construction type, at the front or the rear. The length compensation carriage reacts to force actions which only act on the ski at the front, as well as force actions which only act on the ski at the rear, as well as to force actions which act at the front as well as the rear. This length compensation is the basis for realizing the wedge function. It is manufactured in light metal or in other materials.

1.2 Rotational point according to the lever principle (See FIG. 36, force compensation according to the lever principle) As soon as the ski is deflected at the ski binding assembly plate at the front and at the rear there arises a pivot according to the lever principle (see FIG. 33 force transmission function). So that this rotational point may be ensured according to the use two different construction types may be applied.

Figure 22:
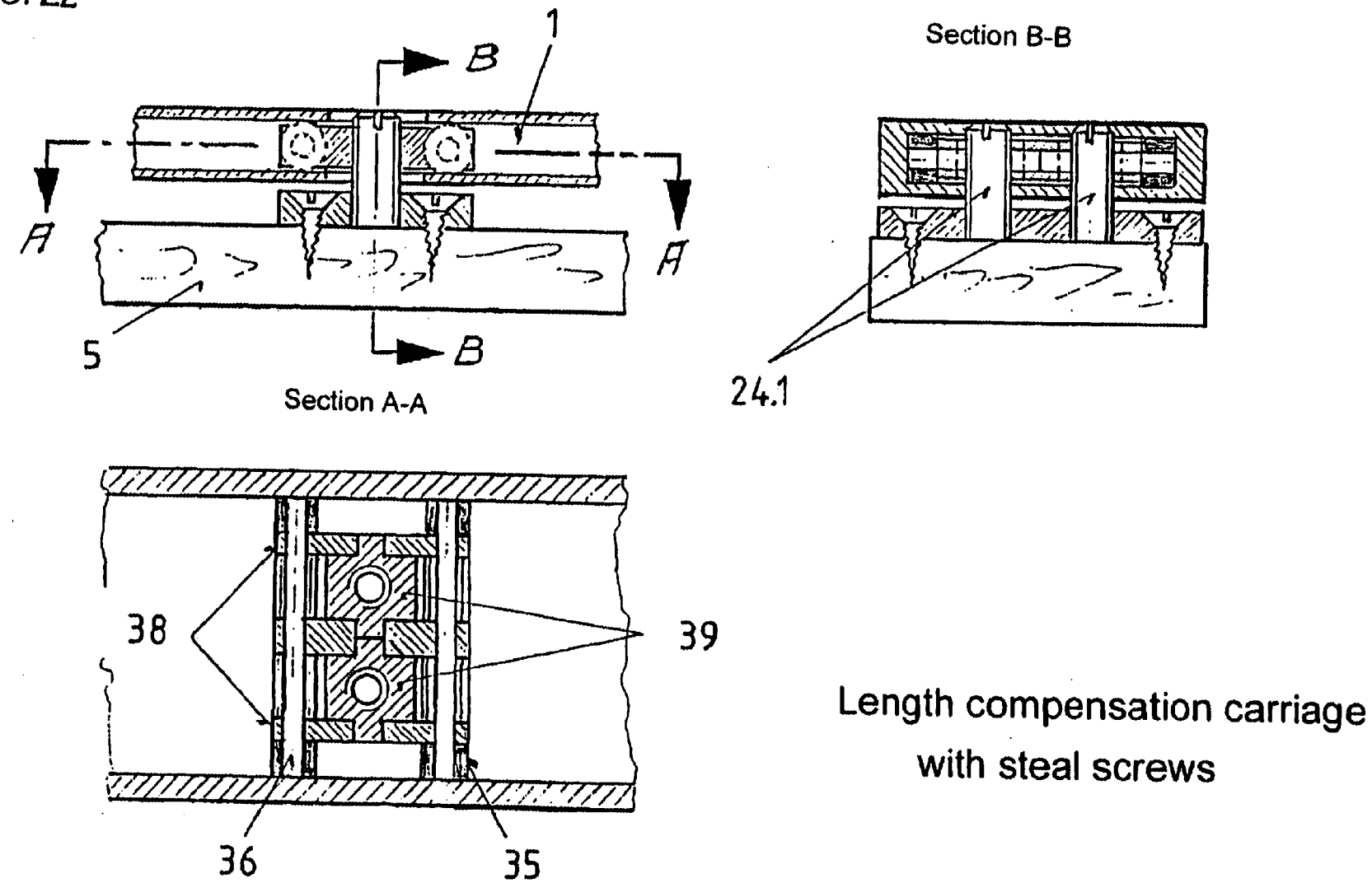
FIG. 22 shows a side sectional view, a front sectional view and a top sectional view of a length compensation carriage.

Length Compensation Carriage With Steel Screws (see FIG. 22)

The steel screws for fastening the ski binding assembly pate on the ski are mounted with two aluminium or steel platelets or other materials which may move in the axial direction. These platelets are guided over aluminium or steel carriers or other materials, by way of two axles, on rollers.

Figure 23:
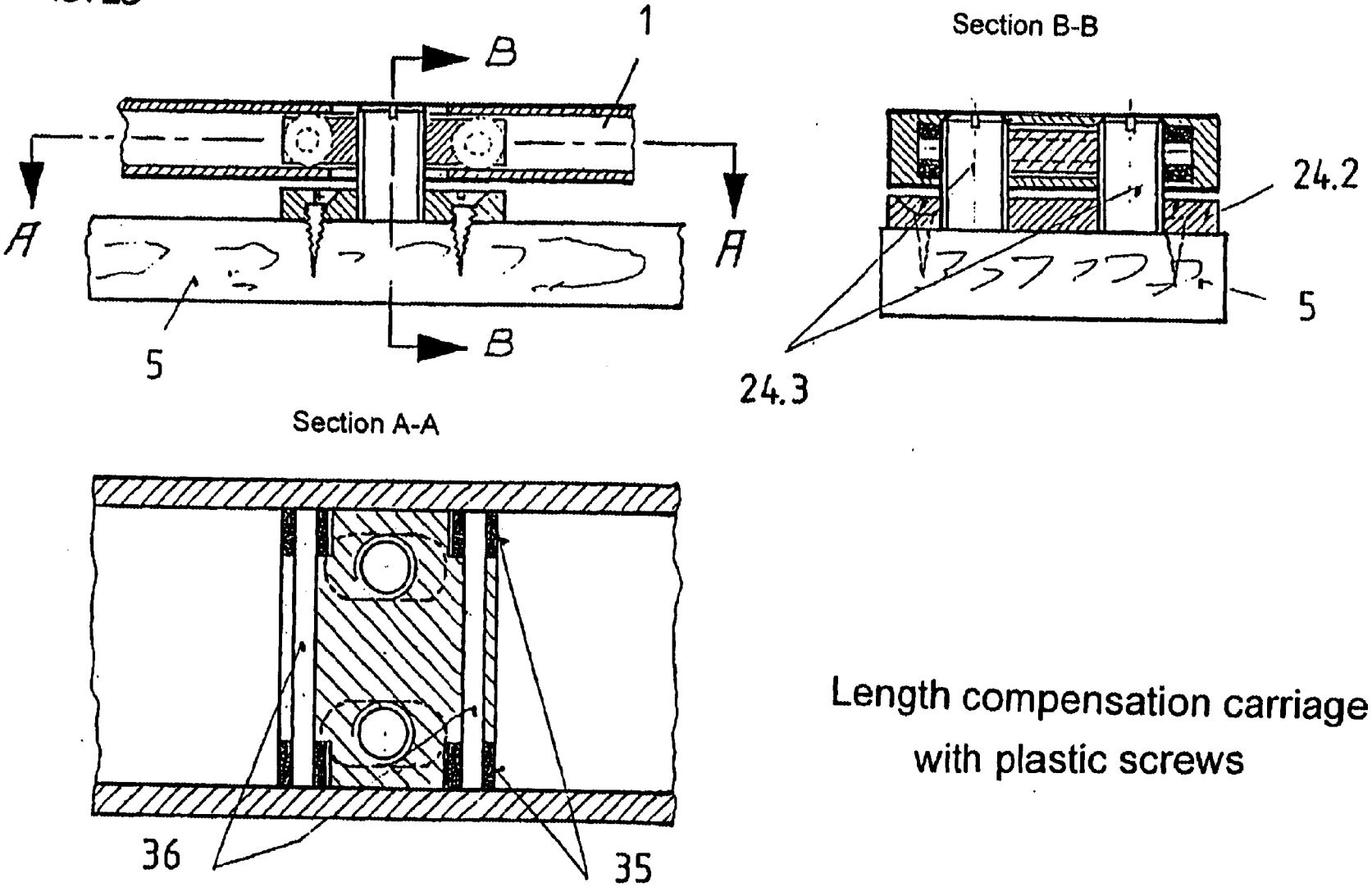
FIG. 23 shows a side sectional view, a front sectional view and a top sectional view of a length compensation carriage.

Length Compensation Carriage With Plastic Screws (see FIG. 23)

The plastic screws for fastening the ski binding assembly plate on the ski permit on account of their elasticity for the length compensation carriage to be adapted in inclination to the bending moment. For obtaining the strength larger screws are used. (see FIG. 2, arrangement of the functions)

Figure 35:
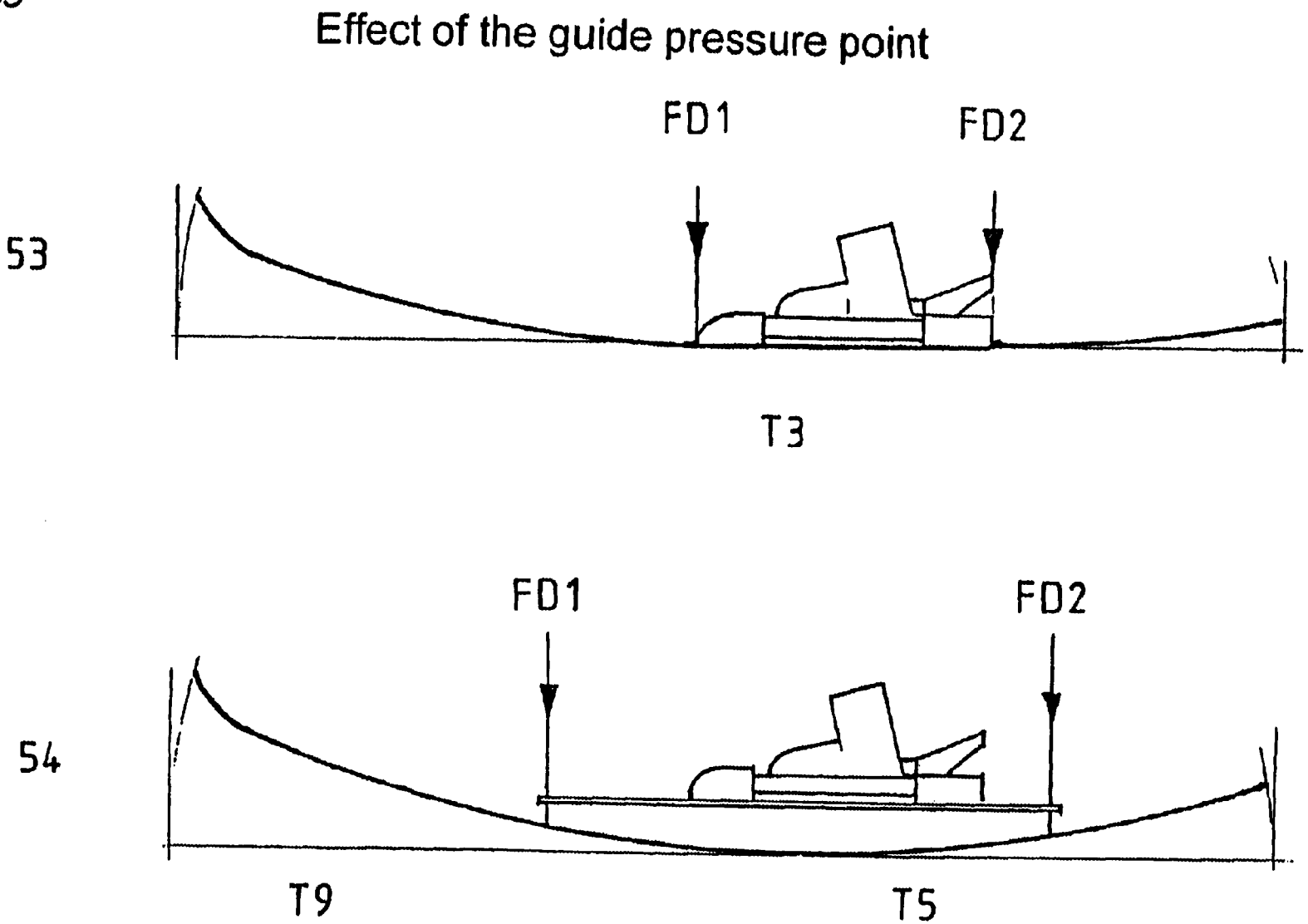
FIG. 35 shows a schematic diagram of an effect of guide pressure point.

1.3 Action Of The Guide Pressure Points (see FIG. 35)

The ski guiding, the vibrations and the smooth running at the front and rear are dependent on the position of the guide pressure points. The guide pressure point FD1 is important for the introduction of the momentum. It is placed on the ski further forwards. The guide pressure point FD2 is important for the guide phase or closure phase of the momentum. It is placed on the ski further to the rear. This effects a more consistent guiding of the ski, less vibration and a greater running smoothness.

1.4 Adjusting The Guide Pressure Point

For adjusting the guide pressure point FD1 and FD2, or fastening the ski binding assembly plate on the ski, the plate has various bores or a slot so that via an adjusting screw any position may be set. These positions lie for the front guide pressure point FD1 in the region of 25 cm to 50 cm, measured from the assembly point in the middle of the ski shoe, up to the front guide pressure point FD1 and for the rear guide pressure point FD2 in the region of 25 cm to 40 cm, measured from the assembly shoe in the middle of the ski shoe, up to the rear guide pressure point FD2.

Figure 36:
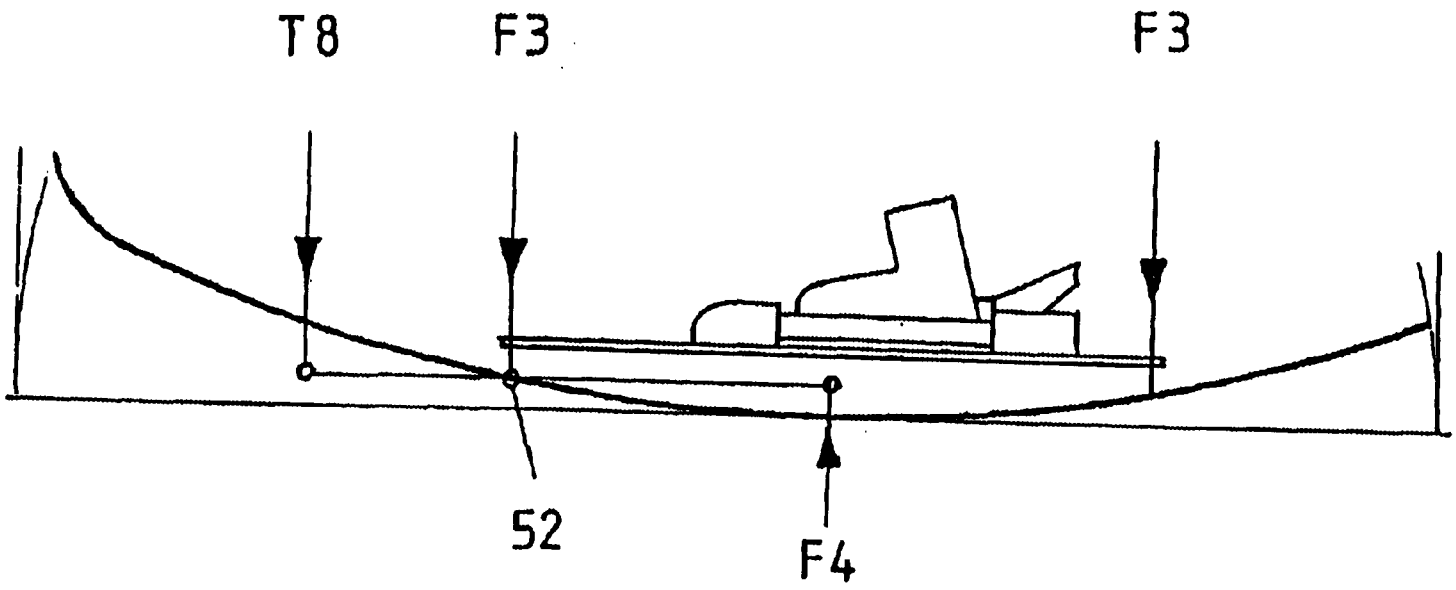
FIG. 36 shows a schematic diagram of a force compensation according to a lever principle.

1.5 Force compensation according to the lever principle (see FIG. 36)

With the intrinsic weight and the centrifugal force F3 in the curve and the counter pressure F4 from the ground or the snow there arise forces according to the lever principle, on account of which the two forces F3 and F4 mutually compensate. This acts favorable on the vibrations and knocks. One may expect additionally an increased running smoothness of the ski.

1.6 Force Compensation. By Way Of Force Compensation Function Or Wedge Function (see FIGS. 33, 34)

With the counter pressure F4 the free bending moment in the region of the binding is unfavorably influenced. This negative effect is prevented by a force transmission system or a wedge function or in combination with both systems.

2. Force Transmission System 2.1 Force Transmission Function (see FIG. 33)

The free bending moment is ensured by way of the force transmission function because the force action F6 according to the curve via a pivot according to the lever principle is converted into a resulting force F5 which lifts the counter pressure F4. The length of the force transmission tabs is on account of the force ratio defined according to the lever principle. With an adjusting screw the height is adjusted and a fine adaptation of the ski is carried out.

This system effects additionally to the free bending moment, less vibration and thus a better grip, particularly on hard snow.

Figure 32:
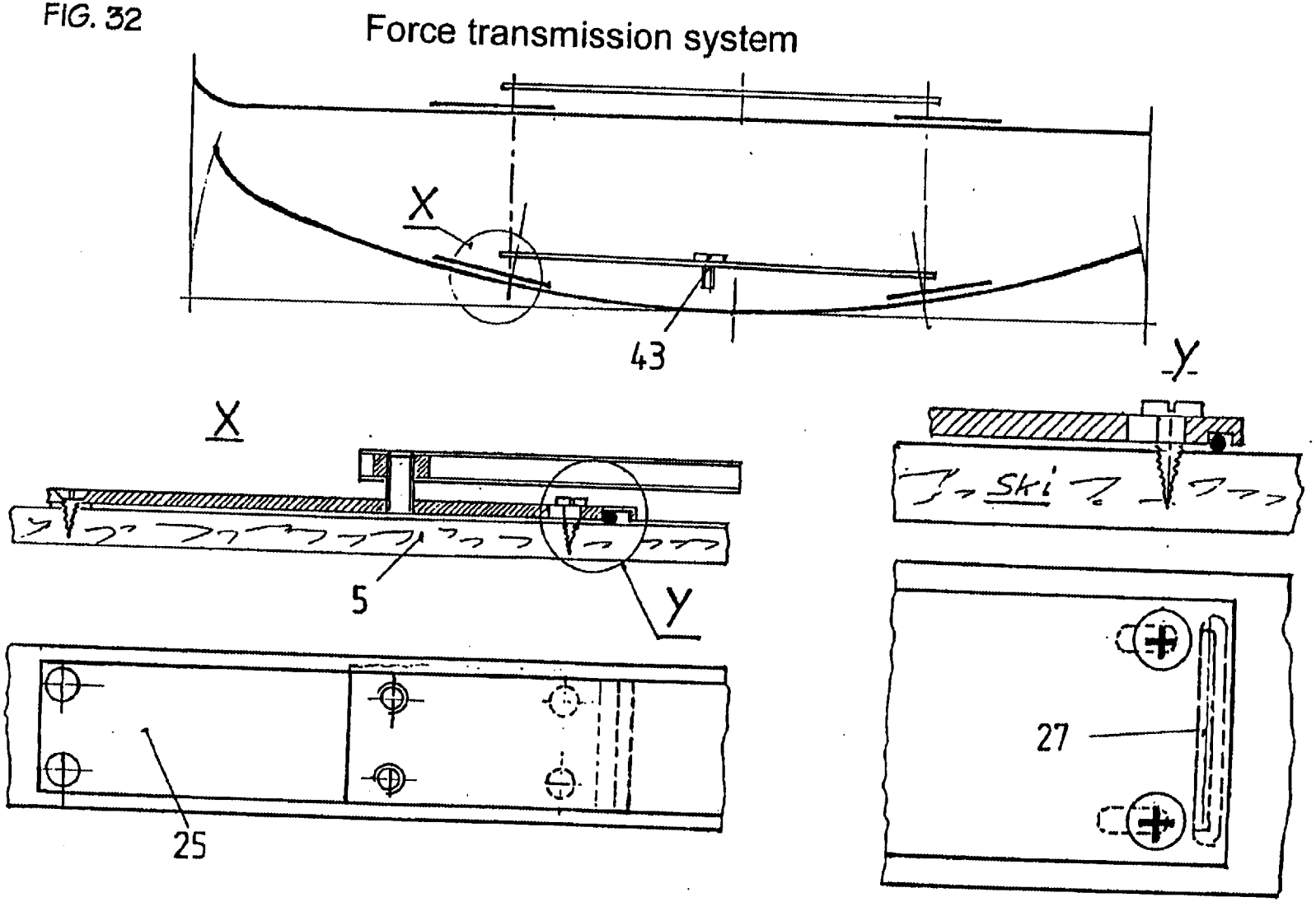
FIG. 32 shows a diagrammatic view, a side sectional view for a front area, a top view for a front area, a side sectional view for a rear area and a top view for a rear area of a forced transmission system.

2.2 Construction Type Of The Force Transmission System (see FIG. 32)

The force transmission tabs are manufactured in light metal or plastic or other materials and rigidly screwed on the front part or rear part of the ski. A plastic U-disk ensures a slight bending moment. With the bending moment of the ski between the tab and the ski there arises a length distance of up to 2 mm. This length compensation is milled in the tabs using longitudinal grooves in the direction of the middle of the ski. The fastening is effected with special flat head shank screws and a plastic U-disk in order to ensure a slight bending moment and a smaller friction for the length compensation. Instead of the plastic U-disk the friction may be lifted with a roller which runs in a groove transversely to the length compensation.

Figure 30:
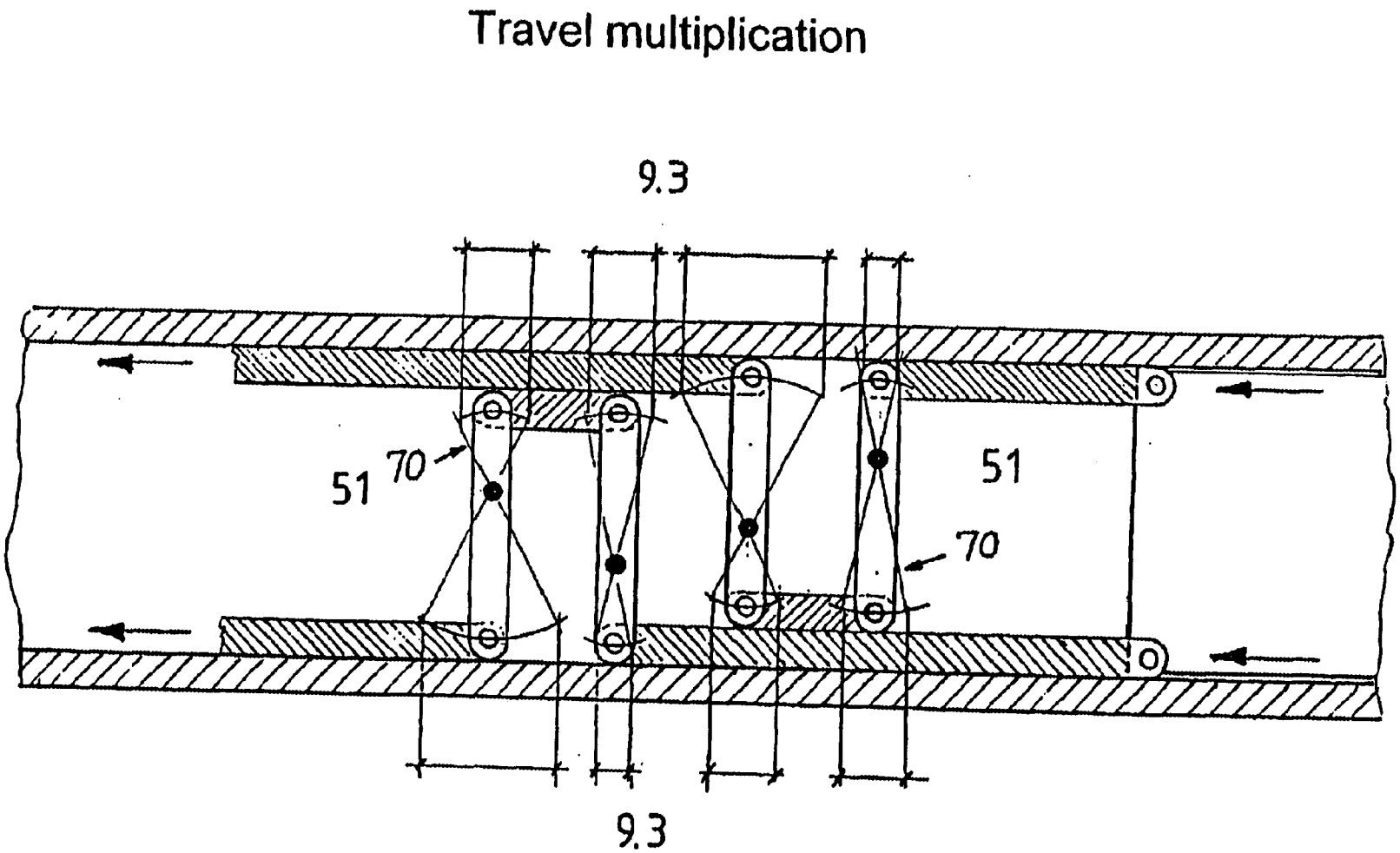
FIG. 30 shows a side sectional view of a travel multiplication apparatus.
Figure 31:
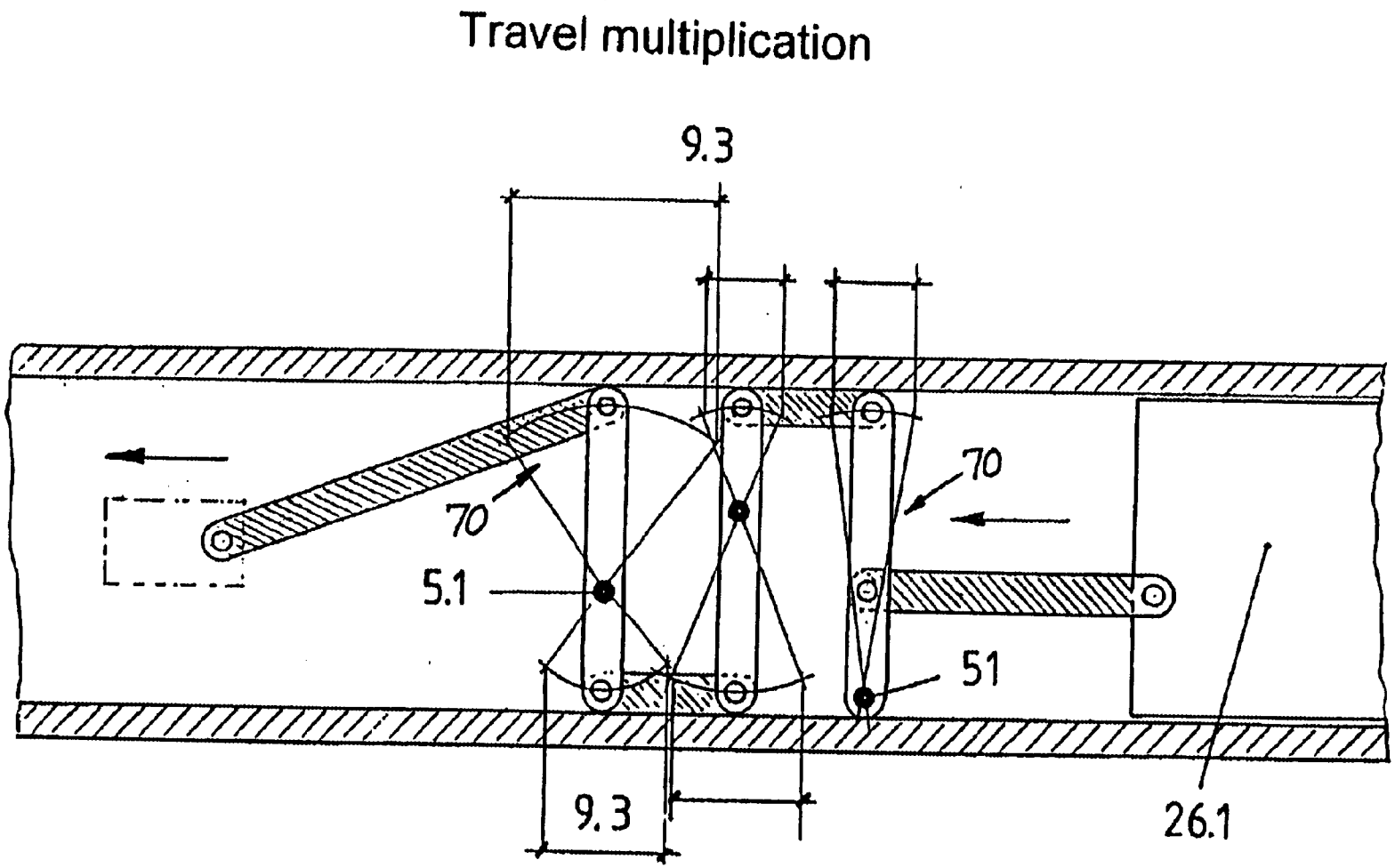
FIG. 31 shows a side sectional view of a travel multiplication apparatus.

3. Travel Multiplication (see FIGS. 30, 31)

The travel multiplication multiplies the reaction force of the length compensation carriage from maximum 8 mm to a travel of approximately 30 mm. According to the construction type of the wedge function this is converted into a co-running or counter-running direction. It may according to the requirement of the wedge function be assembled at various positions in the plate. The force transmission is effected via light metal tabs or tabs 70 manufactured of other materials which are arranged according to the lever principle.

3.1 Travel Multiplication With Gearwheel Gear

The force transmission is transmitted via a gearwheel gear with a rack of plastic or other materials.

3.2 Travel Multiplication With A Tension Or Compression Spring (see FIG. 2)

In order to counteract the inertia of the whole system of the ski, on the force transmission lever a tension or compression spring may be placed.

Figure 29:
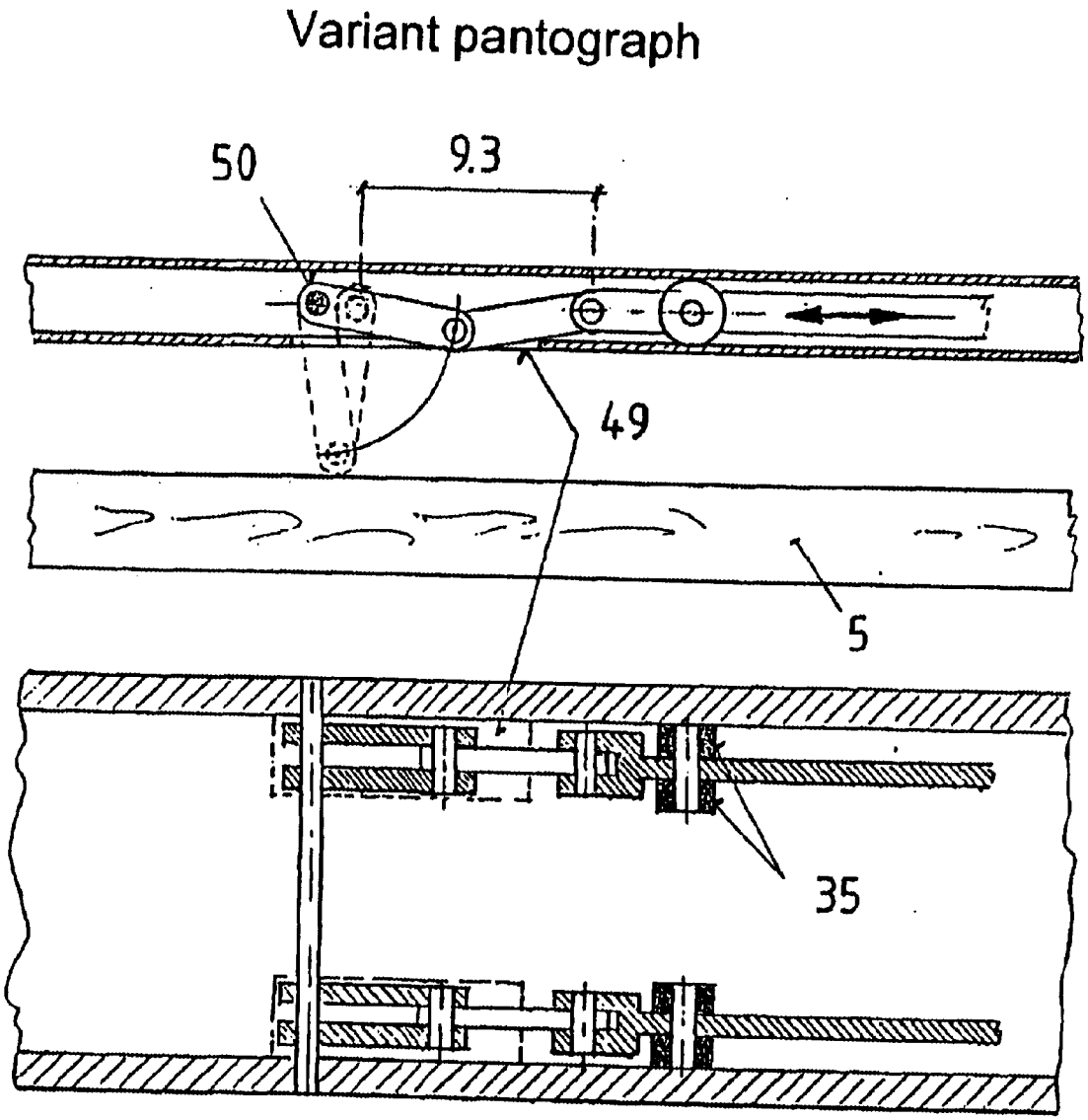
FIG. 29 shows a side sectional view and a top sectional view of a pantograph.

3.3 Travel Multiplication With An Implemented Wedge (see FIG. 29)

In the travel multiplication there is co-implemented a wedge function of light metal or other materials in order to prevent a propelling-back of the forces. This is necessary for the application of a pantograph of light metal or other materials.

4. Wedge Function (see FIG. 34)

The wedge function lifts the unfavorable bending moment which arises by way of the counter pressure F4. The initial point is the length compensation carriage which reacts to the smallest force action F6 according to the curve (reaction path up to approximately 8 mm). This path of 1–8 mm is multiplied via the travel multiplication to maximum 30 mm. The 30 mm correspond to the maximum required wedge movement. The wedge has an inclination of 15 degrees and thus a good precondition for the force transmission onto the adjusting screw. This is required for the height adjustment and for a fine adaptation of the ski.

Oppositely, the counter force F4 acts from the ground or the snow at an angle of 75 degrees onto the wedge and is thus not in the position of influencing the wedge. Thus the recoil force is eliminated. The free bending moment is ensured by the wedge which extends out the adjusting screw according to the radius of the ski. This results in no vibration and thus an improved grip particularly on hard snow.

According to the use various construction types in light metal and plastic or other materials are used.

Figure 25:
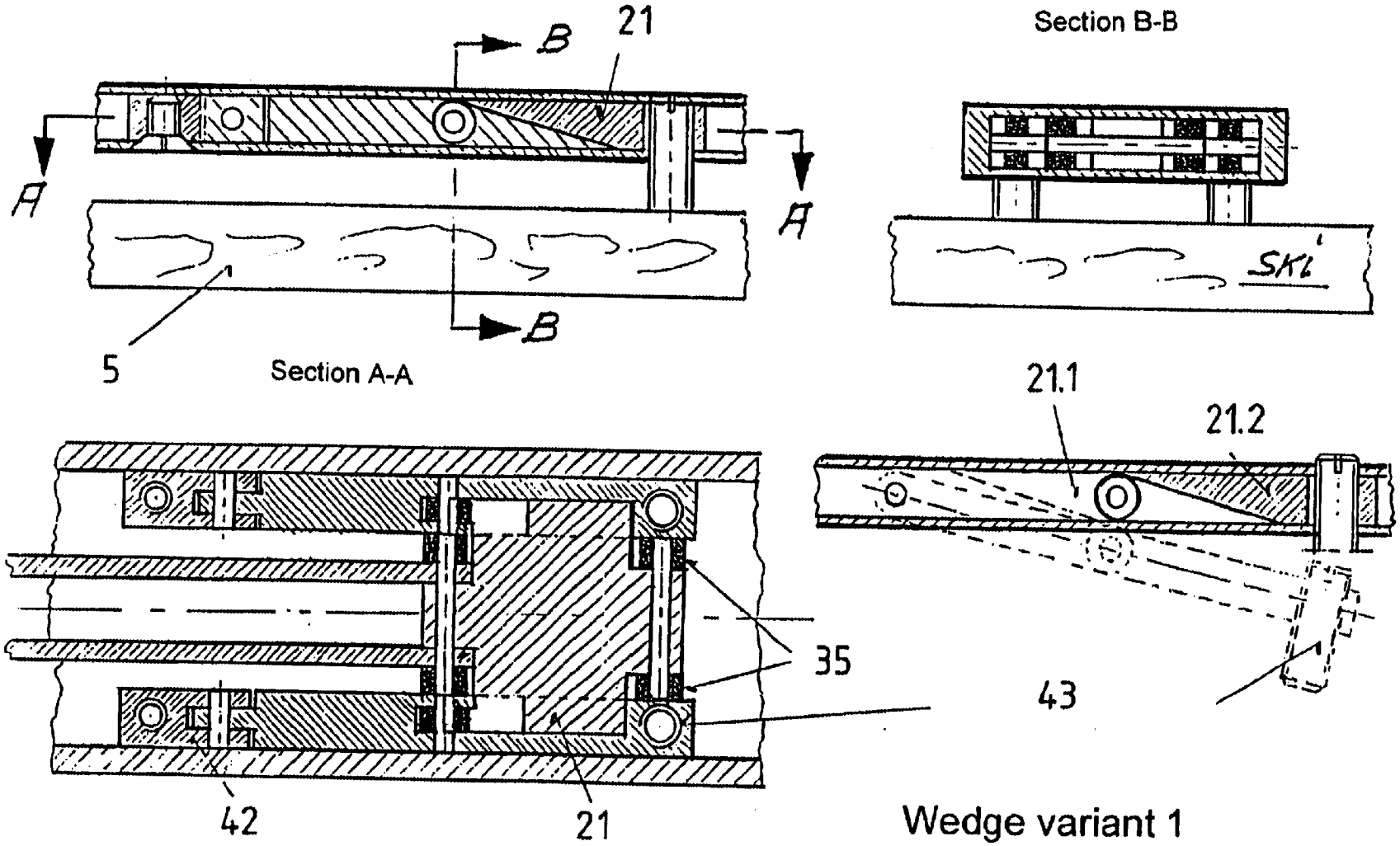
FIG. 25 shows a side sectional view, a front sectional view, a top sectional view and a partial side view of a wedge apparatus.

4.1 Wedge Variant 1 (see FIG. 25)

The travel of maximum 30 mm is assumed by the travel multiplication and transferred to a carriage with rollers on which, on both sides there is milled a wedge of 15 degrees. This carriage is manufactured of light metal or plastic or other materials. The adjusting screw is extended via a lever arm of light metal or plastic or other materials, which from the wedge via a roller is actuated and fastened on the ski binding assembly plate via a joint. The extending travel is defined via the length of the lever arm, according to the lever principle.

Figure 26:
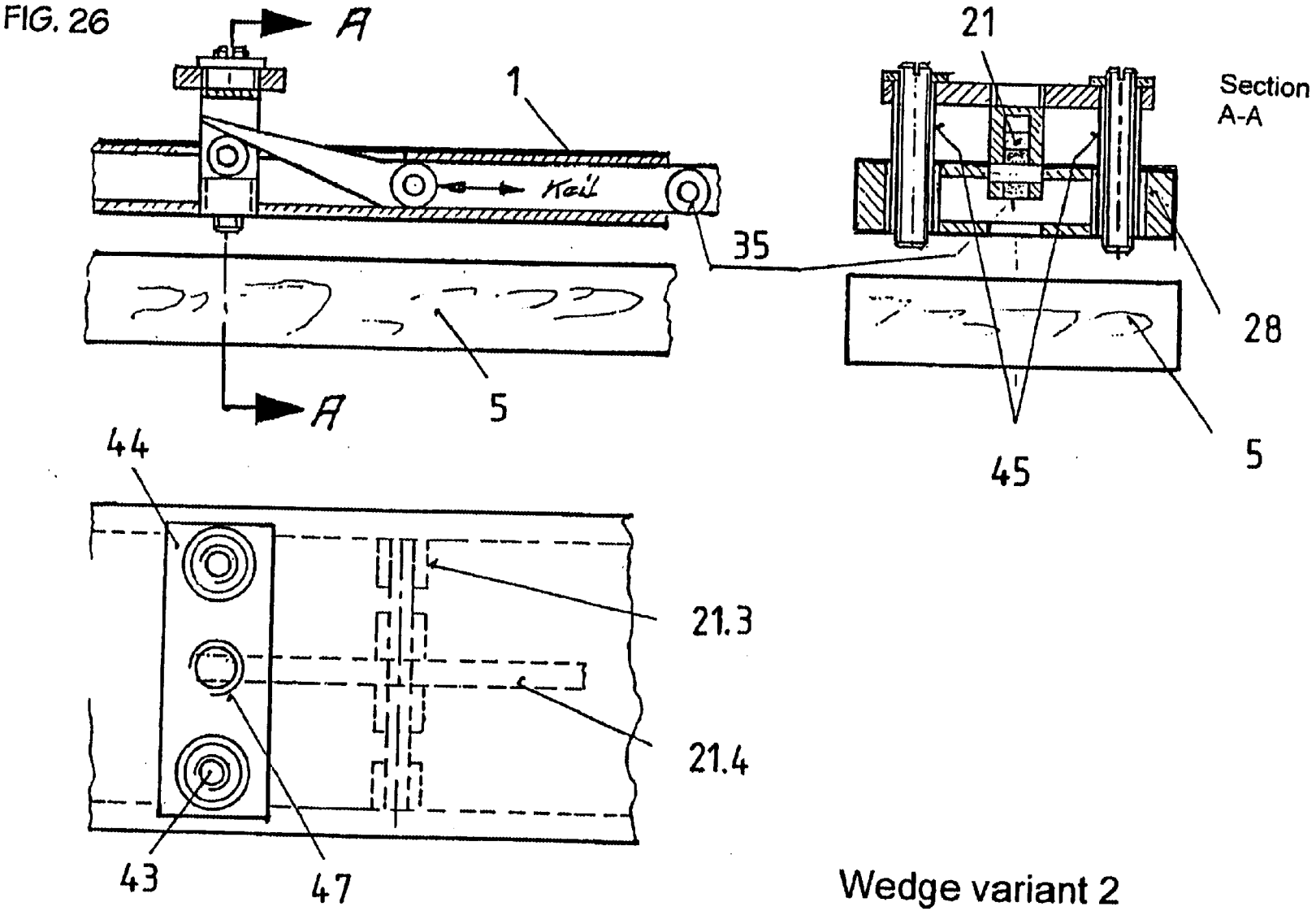
FIG. 26 shows a side sectional view, a front sectional view and a top view of a wedge apparatus.

4.2 Wedge Variant 2 (see FIG. 26)

The travel of maximum 30 mm is transferred by the travel multiplication onto a wedge of light metal or another material which is guided on rollers. This actuates a roller which is incorporated in a round profile of light metal or another material. The round profile is screwed into a connection plate of light metal or another material which via pressed-in sleeves, of light metal or other materials, actuate the adjusting screw. The sleeves of light metal or of other materials run in plastic bearings which are pressed in the ski binding assembly plate.

Figure 27:
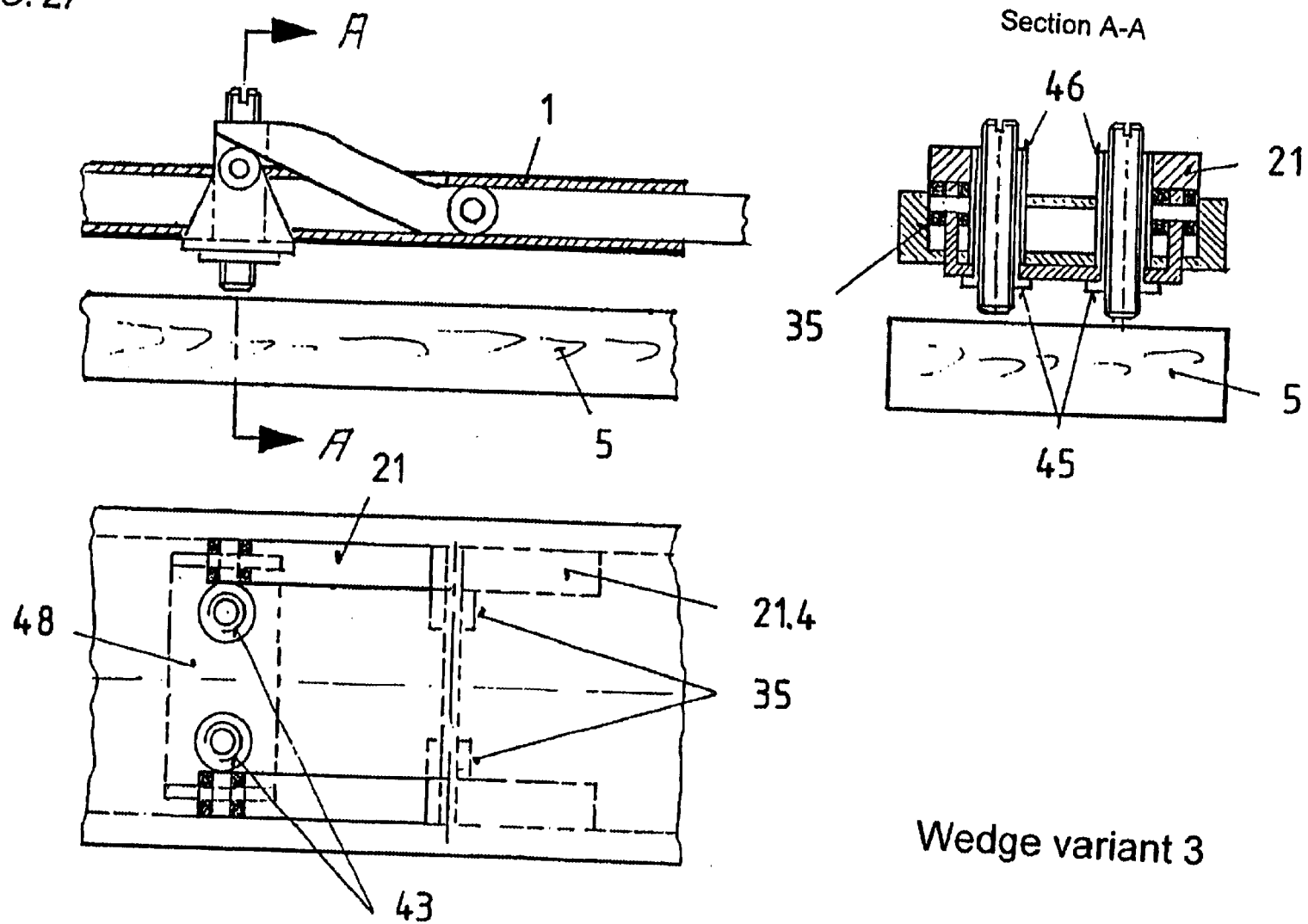
FIG. 27 shows a side sectional view, a front sectional view and a top view of a wedge apparatus.

4.3 Wedge Variant 3 (see FIG. 27)

The travel of maximum 30 mm is transferred by the travel multiplication onto two wedges of light metal or other materials which are guided on rollers. These actuate rollers which by way of a U-profile of light metal or other materials are connected to one another below the ski binding assembly plate. Via this U-profile there are actuated the adjusting screws which are assembled in sleeves of light metal or other material. These sleeves run in plastic bearings which are pressed in the ski binding assembly plate. The adjusting screws with the wedge variant 2 and the wedge variant 3 in the idle condition may not project more than 15 mm from the ski binding assembly plate, otherwise they contact the ski shoe. Thus the travel is limited to approximately 12 mm. The wedge path must be cut out in the upper wall of the ski binding assembly plate. This is done away with when one selects a higher profile. Then also a greater travel may be ensured.

Figure 4:
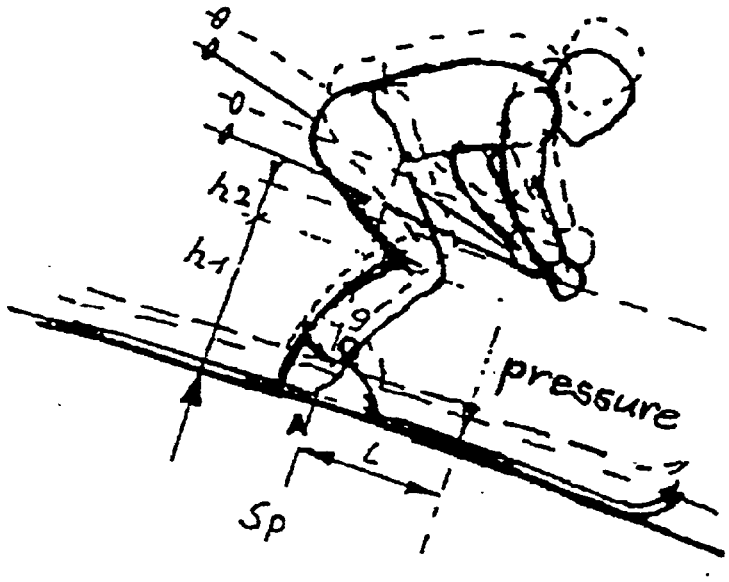
FIG. 4 is a diagrammatic view showing different parameters for height adjustment.

5. Height Adjustment (see FIG. 4)

By way of the height adjustment of the ski binding assembly plate there results a lever principle which has the effect that one may put more pressure onto the front guide part of the ski. The results of this are a more precise momentum introduction, an improved stability and improved guide properties of the ski.

The height adjustment is manufactured of light metal or plastic or in other materials in the following variants.

Figure 11:
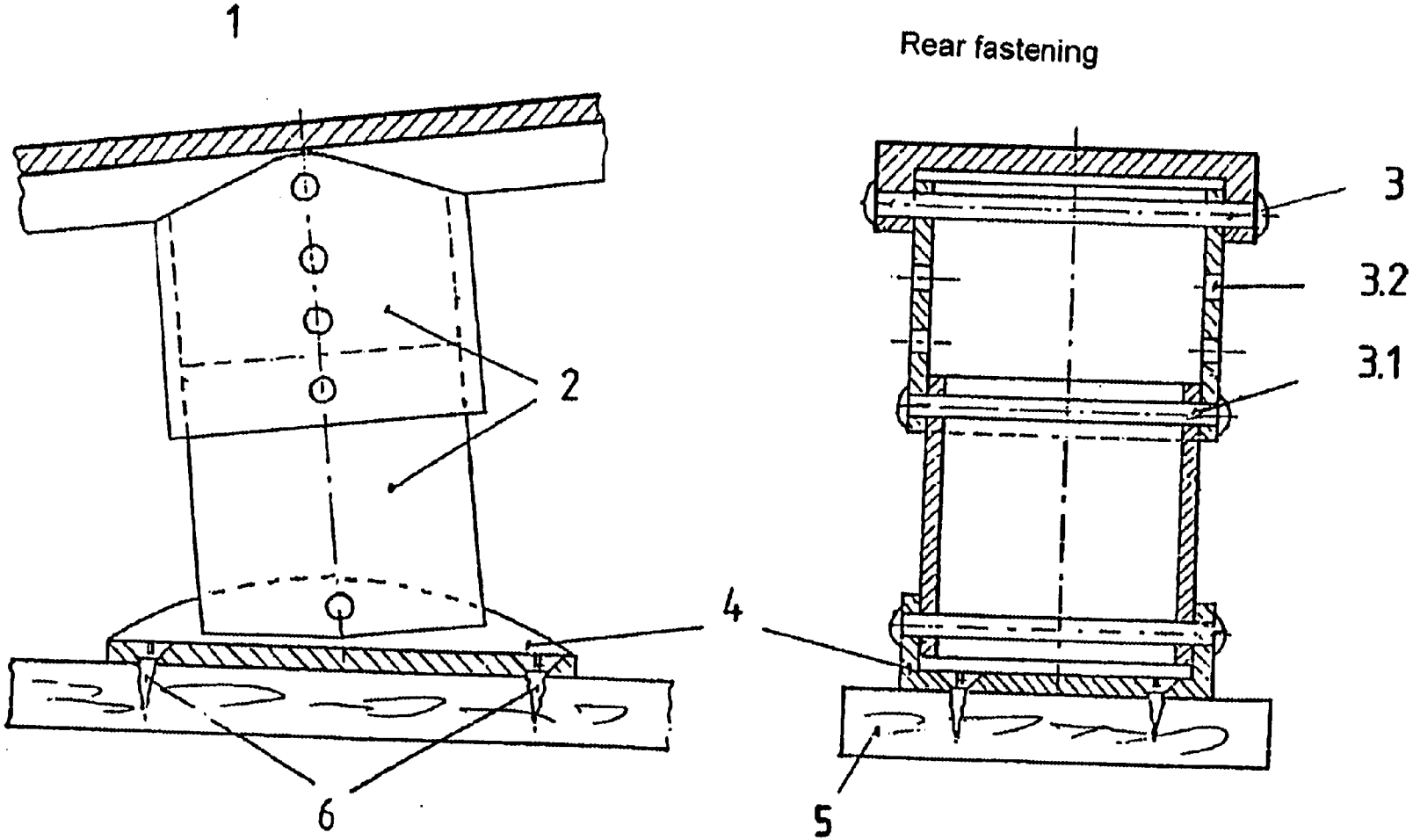
FIG. 11 shows a side partial sectional view and a front sectional view of a height adjustment apparatus according to one embodiment of this invention.

5.1 Height Adjustment With Bolts (see FIG. 11)

Height adjustment with bolts is accomplished with the construction type THP (see FIG. 1).

The front and the rear fastening includes two tubes which have various height adjusting holes so that they may be arrested into one another, at various positions by way of a height adjusting bolt.

Figure 12:
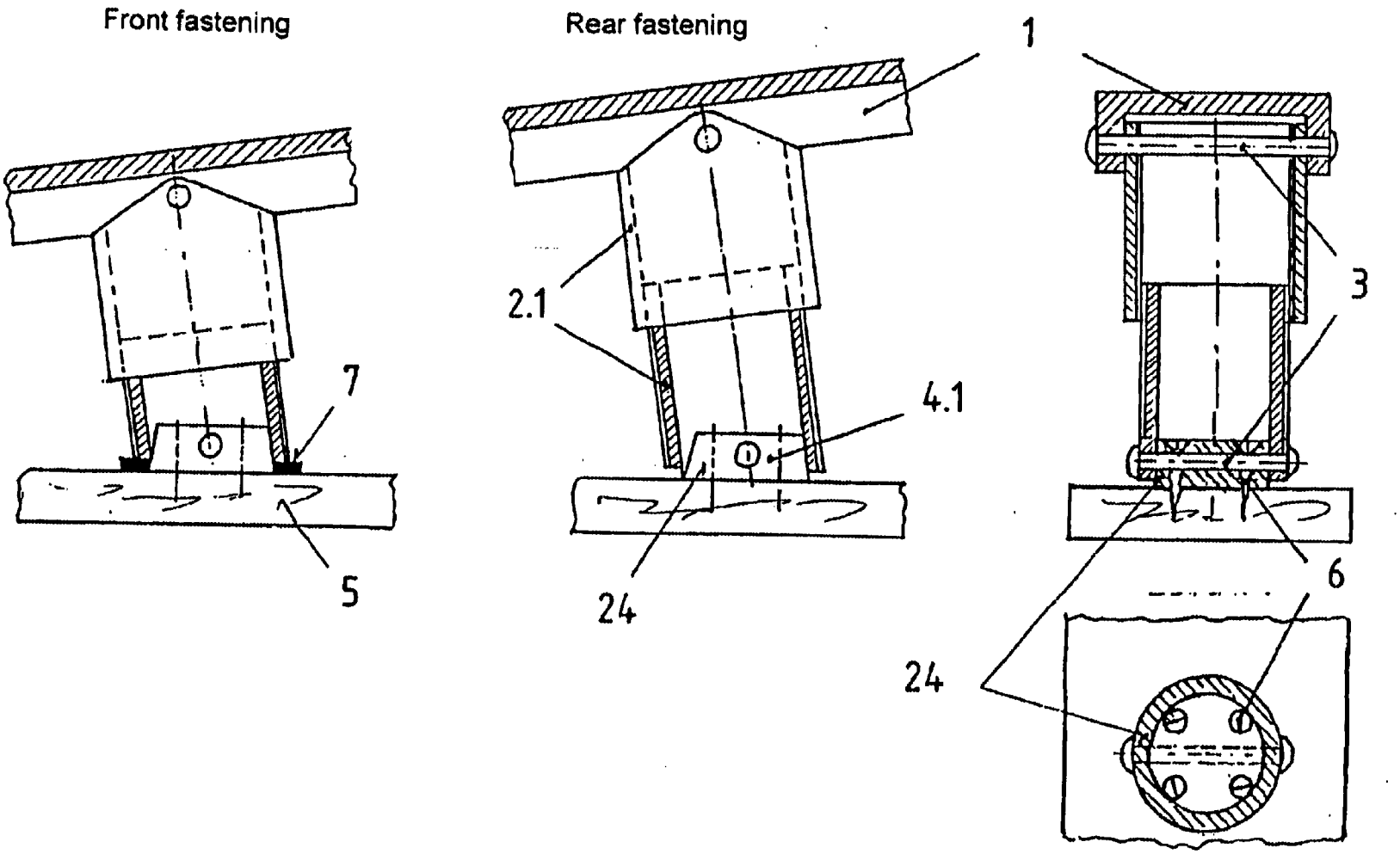
FIG. 12 shows a side partial sectional view of a height adjustment with threads for a front fastening, a side partial sectional of a height adjustment with thread for a rear fastening, a front sectional view and a top sectional view of a fastener.

5.2 Height Adjustment With Thread (see FIG. 12)

Height adjustment with thread is accomplished with the construction type THP (see FIG. 1).

The front and the rear fastening has two tubes which on one side may have a fine thread so that they may be screwed into one another. The arresting on the ski binding assembly plate and on the ski is simultaneously the height arresting so that the tubes with the threads may no longer be rotated.

Figure 13:
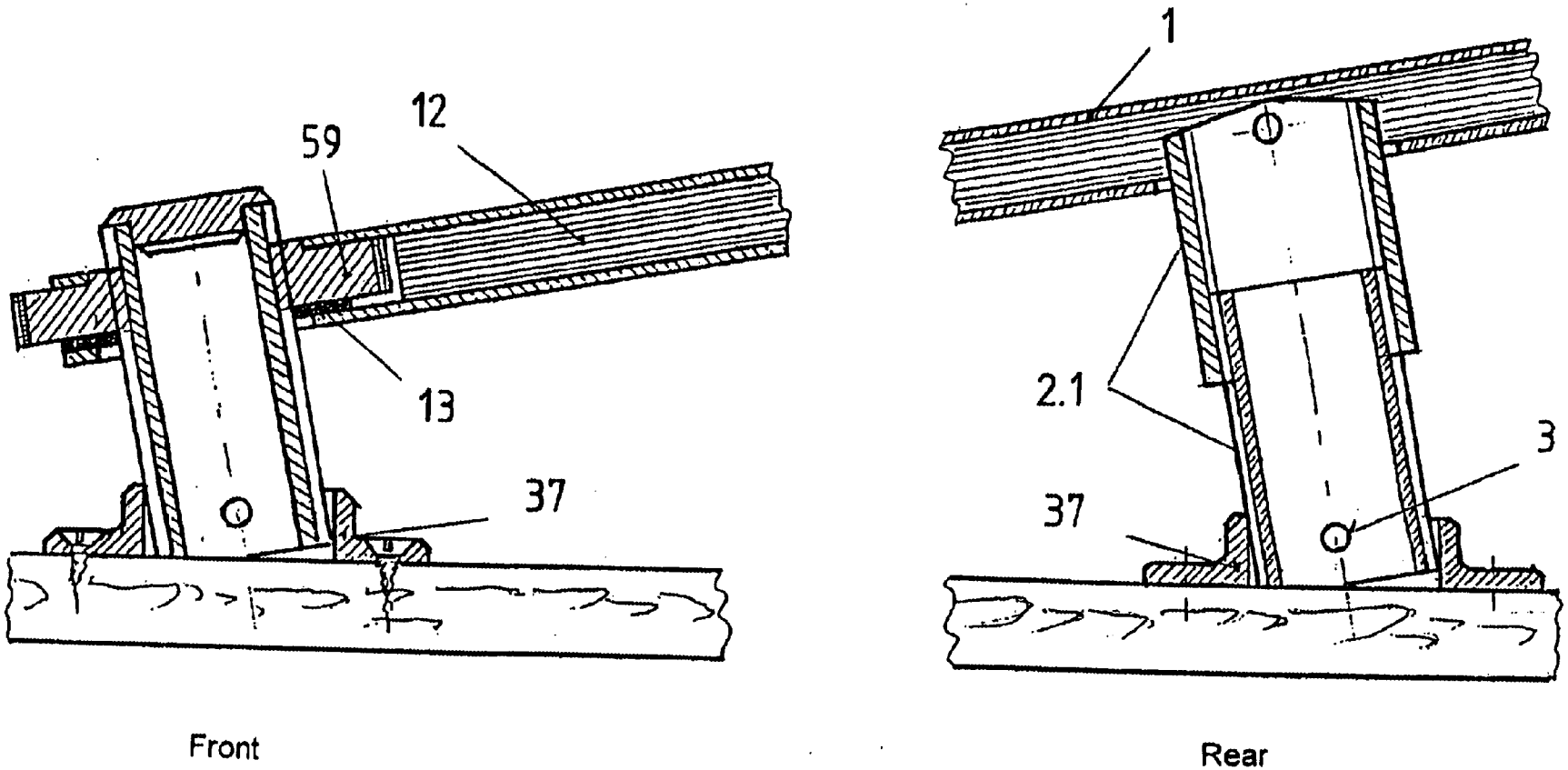
FIG. 13 shows a partial sectional view of a height adjustment with thread for a front fastening and a partial sectional view of a height adjustment with thread for a rear fastening.

5.3 Height Adjustment With A Rotation Disk (see FIG. 13)

Height adjustment with a rotation disk is accomplished with the construction type THP (see FIG. 1).

With this embodiment there is a tube with an outer thread. In the ski binding assembly plate there is attached a rotation disk with an inner thread such that this may be rotated for the height adjustment.

Figure 14:
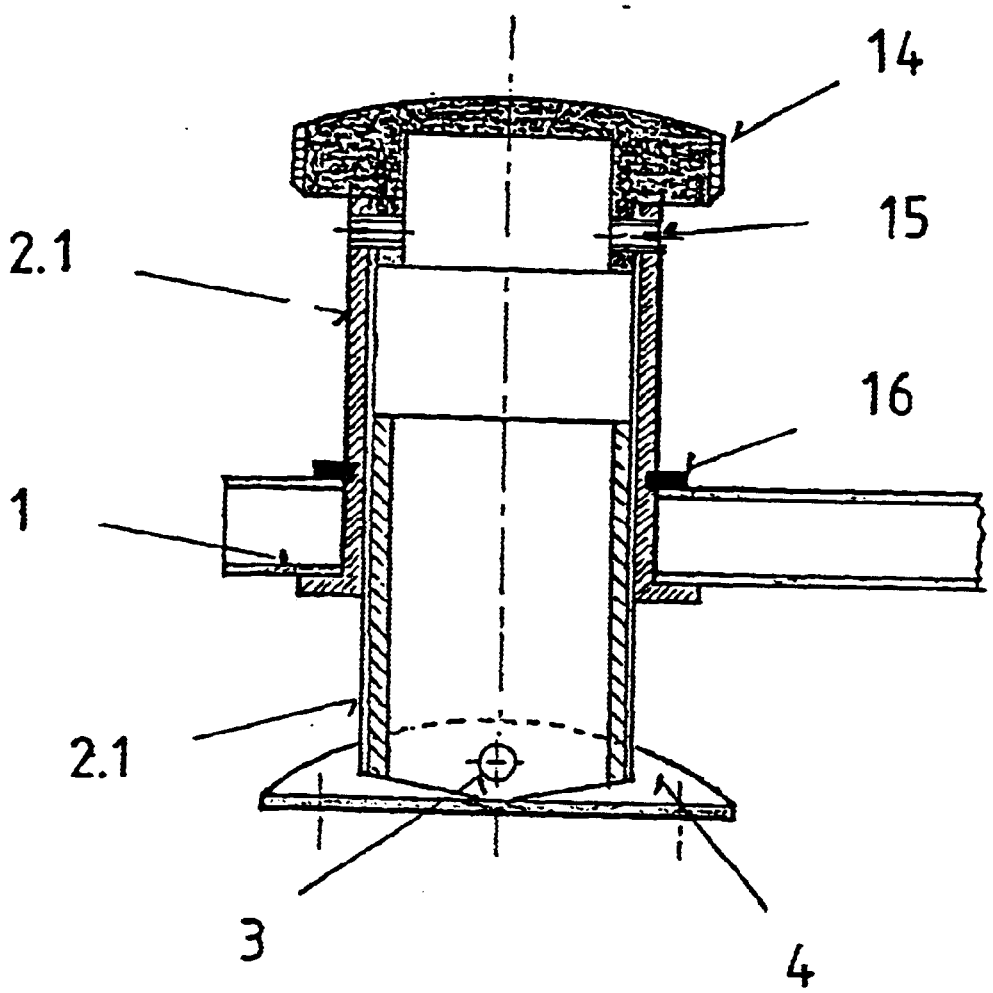
FIG. 14 shows a side sectional view of a height adjustment with thread.

5.4 Height Adjustment With A Rotation Knob (see FIG. 14)

Height adjustment with a rotation disk is accomplished with the construction type THP (see FIG. 1).

This embodiment differs from the embodiment 5.3 height adjustment with a rotation disk (see FIG. 13) because the rotation disk for the height adjustment is exchanged with a rotation knob which is fastend in the ski binding assembly plate with a circlip.

5.5 Height Adjustment With A Rotation Knob (see FIG. 15)

Height adjustment with a rotation knob is accomplished with the construction type THP (see FIG. 1).

This embodiment differs from the embodiment 5.4 height adjustment with rotation knob, (see FIG. 14) because the rotation knob is fastened within the ski binding assembly plate with a circlip. The rotation knob is arrested via an eccentric. The fastening on the ski is attached on the inside on the tube.

Figure 19:
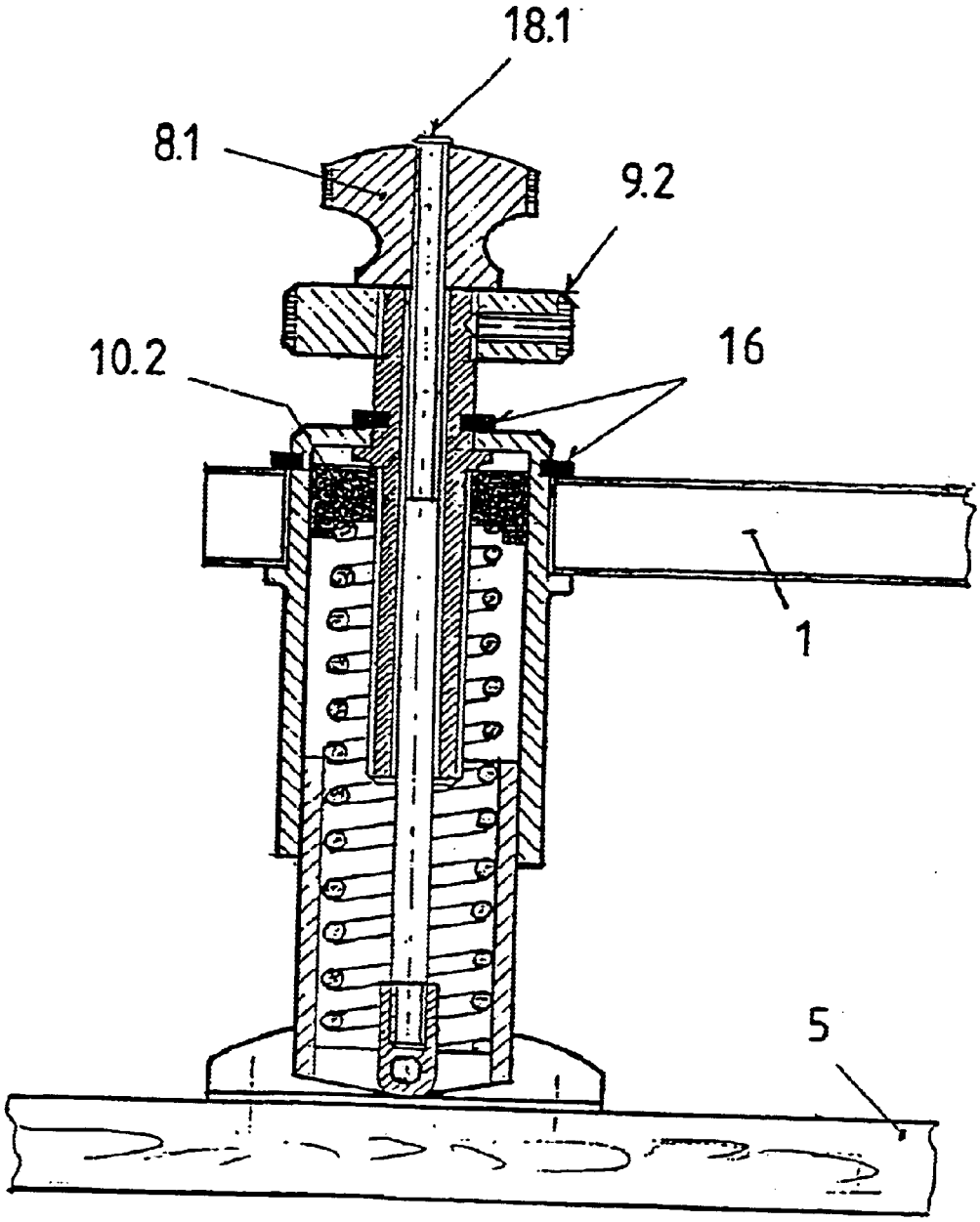
FIG. 19 shows a sectional view of a damping effect by way of compression springs and air cylinder.
Figure 21:
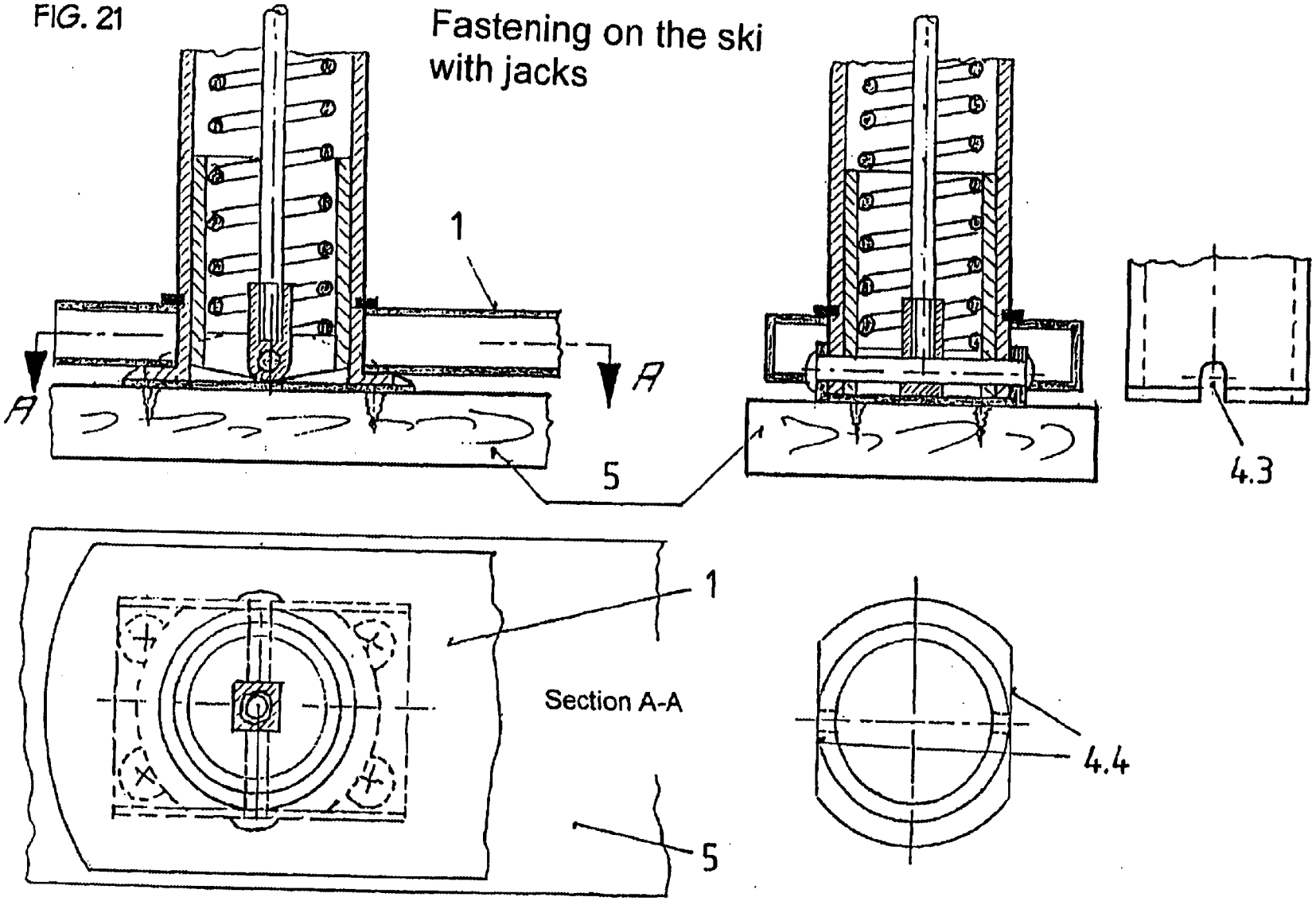
FIG. 21 shows a side sectional view, a front sectional view and a top view of a fastening on the ski with jacks.

FIGS. 19, 20, 21 show embodiments in which the spring pressure may be adjusted. Here the height adjustment is effected via a steel pin with which one limits the spring path.

5.6 Arresting On The Ski

The arresting on the ski is effected with tabs, as in the height adjustment 5.1 with bolts (see FIG. 11), or with a fastening block which is on the inside on the tube (see FIG. 12) or with a round flange (see FIG. 13), and bolts or screws or a quick closure so that the tubes may slightly incline. For this purpose there is a slight milling on the tubes. The fixed point is defined in that one does not provide a milling on the tubes for the inclining.

Figure 16:
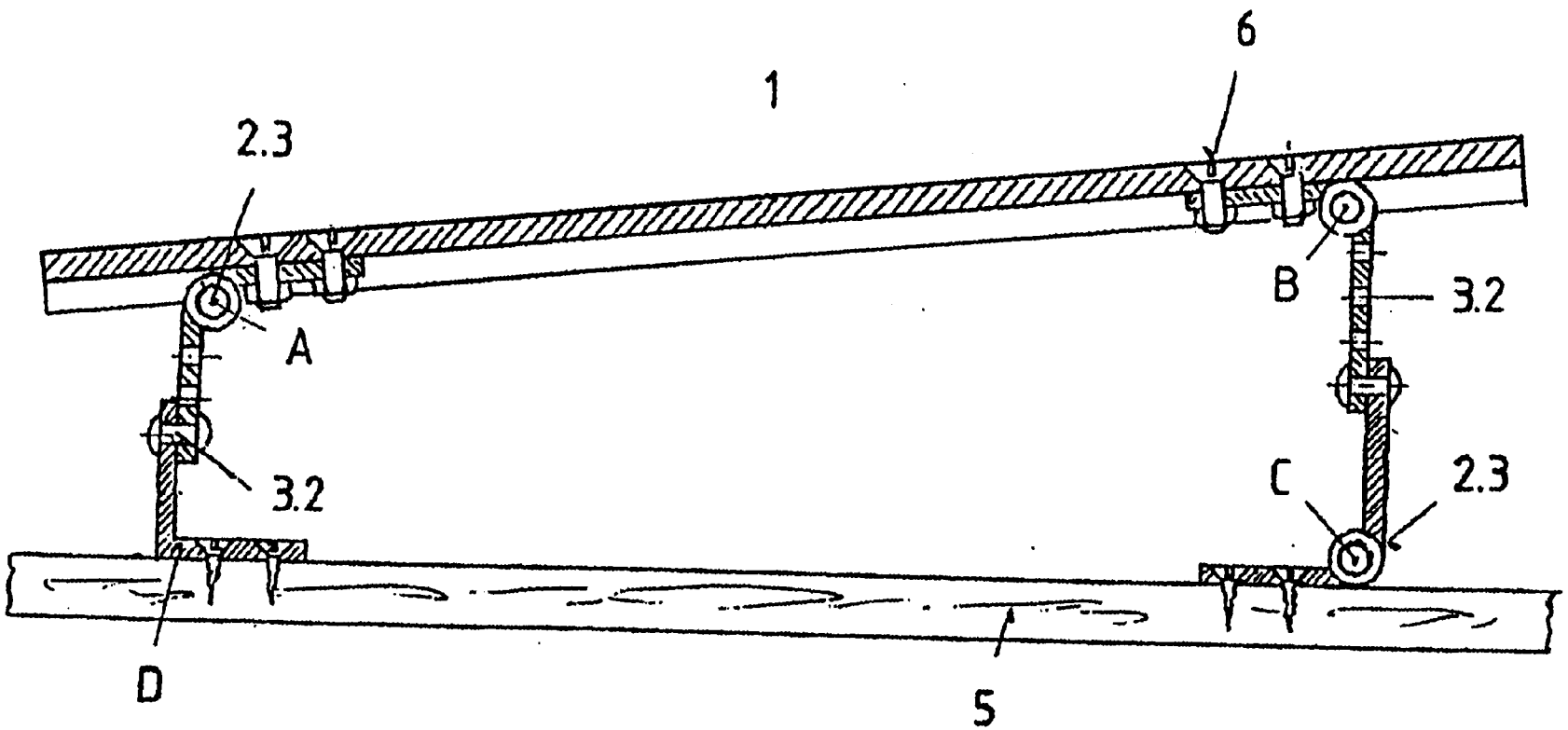
FIG. 16 shows a side sectional view of a height adjustment with hinges.
Figure 17:
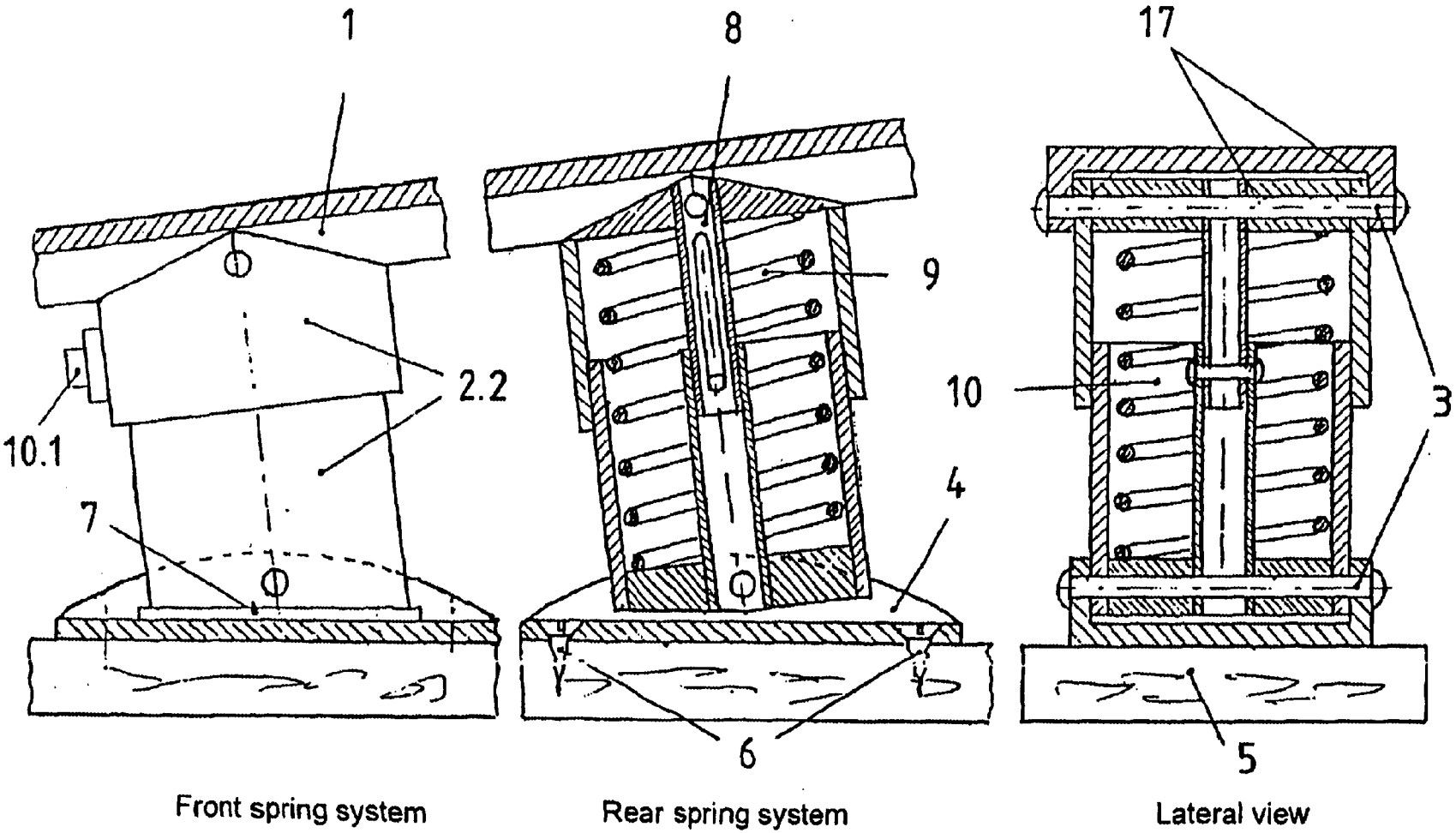
FIG. 17 shows a side partial sectional view of a front spring system, a side sectional view of a rear spring system and a front sectional view, each of a damping effect by way of spring and air cylinder.

5.7 Height Adjustment By Way Of Hinges (see FIG. 16)

Height adjustment by way of hinges is accomplished with the construction type THP (see FIG. 1).

The front and the rear fastenings include hinges of light metal or other materials which are fastened on the ski binding assembly plate and on the ski so that these and various height adjusting holes may be screwed together at various positions. The definition of the fixed point is effected via the fastening with an angle.

Figure 18:
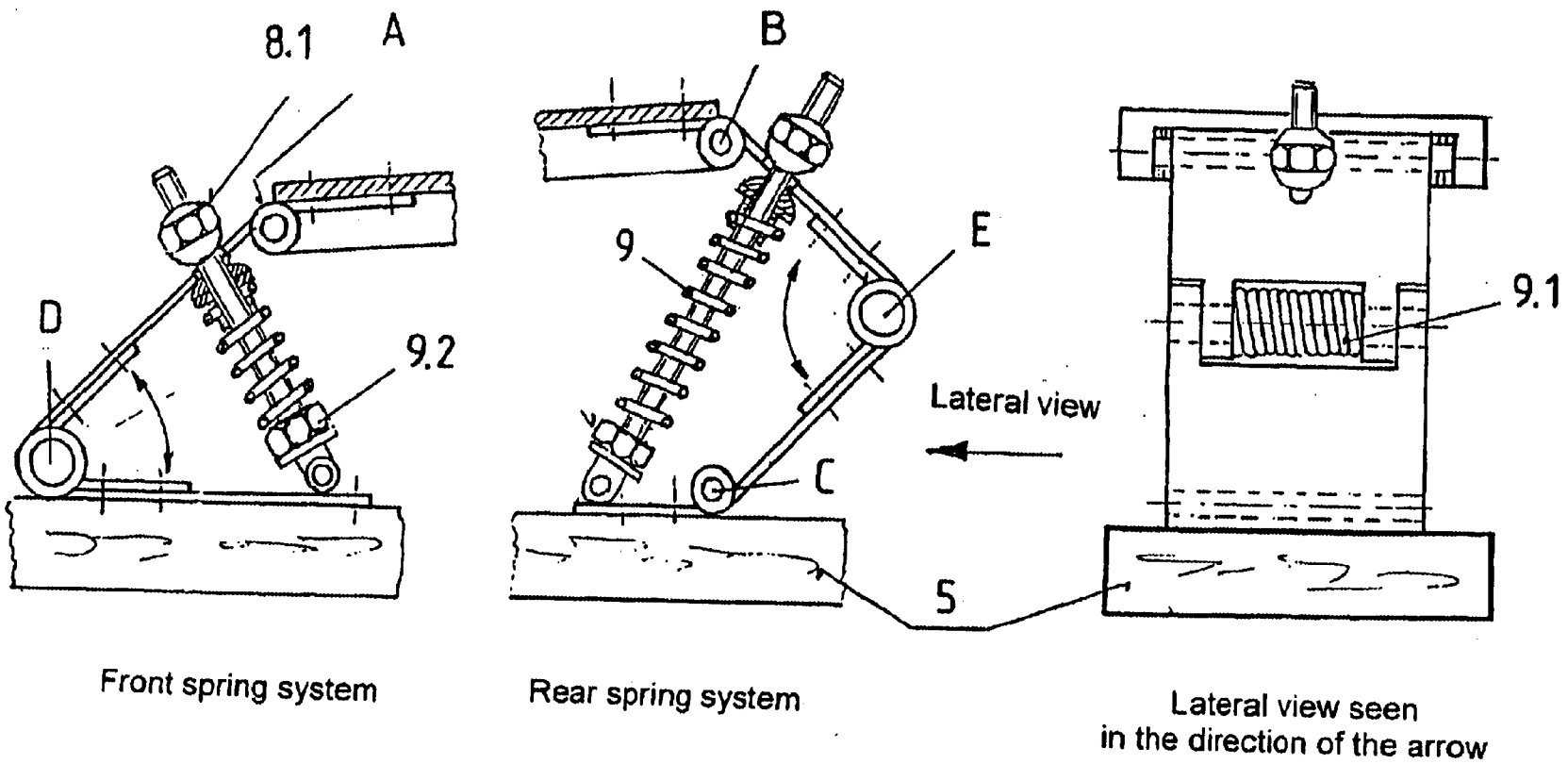
FIG. 18 shows a side partial sectional view of a front spring system, a side partial sectional view of a rear spring system, and a front view, each of a damping effect by way of leg springs and hinges or compression springs.

5.8 Height Adjustment With Hinges And Damping Effect By Way Of Leg Or Compression Springs (see FIG. 18)

Height adjustment with hinges and damping effect by way of leg or compression springs is accomplished with the constructional type THP (see FIG. 1).

The hinges are arranged such that the ski binding assembly plate may move in height. The height adjustment is effected via a height arresting screw.

5.9 Height Adjustment by Way Of A Length Compensation Carriage and steel screws (see FIG. 22) Height adjustment by way of a length compensation carriage and steel screws is accomplished with the construction type LCC (see FIG. 2).

The height adjustment of the ski binding assembly plate at the front or rear is effected via steel screws which are guided in a length compensation carriage over movable platelets of light metal and other materials and carriers on rollers. The fastening to the front and rear on the ski is effected via a fastening plate or with self-tapping insert bushings which are screwed directly in the ski and have an inner thread, or via force transition tabs. (see FIG. 32 force transmission system).

5.10 Height Adjustment By Way Of A Rigid Fastening And Steel Screws (see FIG. 24)

Height adjustment by way of a rigid fastening and steel screws is accomplished with the construction type LCC (see FIG. 2).

On the counter side of the length compensation carriage on the ski binding assembly plate at the front or the rear there is effected a rigid fastening with steel screws which are attached such that via a movable plate they give way to the bending moment of the ski.

5.11 Height Adjustment By Way Of A Length Compensation Carriage And Plastic Screws (see FIG. 23)

Height adjustment by way of a length compensation carriage and plastic screws is accomplished with the construction type LCC (see FIG. 2).

The height adjustment of the ski assembly plate at the front and the rear is effected via plastic screws which have a slight elasticity and thus do not require a movable part in the length compensation carriage.

5.12 Height Adjustment By Way Of A Rigid Fastening And Plastic Screws (see FIG. 24)

Height adjustment by way of a rigid fastening and plastic screws is accomplished with the construction type LCC (see FIG. 2).

On the counter side of the length compensation carriage, on the ski binding assembly plate at the front and rear there is effected a rigid fastening with plastic screws via a reinforcement plate.

The fastening of the ski binding assembly plate with plastic screws at the front and rear on the ski makes possible the bending moment of the ski.

The fastening screws may in all fastenings be exchanged according to height adjustment.

Figure 5:
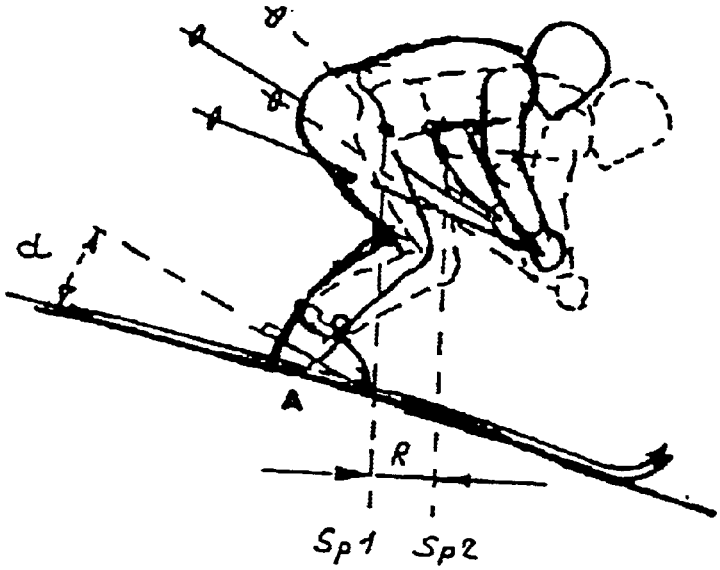
FIG. 5 is a diagrammatic view showing different parameters for inclination angle adjustment.

6. Inclination Adjustment (see FIG. 5)

By way of an inclination of the ski binding assembly plate up to approximately 20 degrees to the front the force, by way of the intrinsic body weight, which in the curve increases on account of centrifugal force, is additionally increased on the front guide part of the ski. There arises an enormous gripping ability by which the reaction capability of the ski is increased. This provides wonderful skiing and one may stick to curves as on rails. This effect may be fully exploited when carving snow.

6.1. Inclination Adjustment

The adjustment of the inclination is effected via the same mechanisms as described in the height adjustment. It is effected in that the ski binding assembly plate in the front part of the ski is set lower.

7. Damping Effect (see FIG. 6)

With the help of a damping system vibrations and knocks are accommodated. With a large jump the damping system assumes a large part of the muscle force. The skiing becomes softer and therefore lighter with regard to the bodily effort. One has an improved stability and running ability of the ski and thus may increase the skiing speed. The damping effect simplifies the turning of a curve, by which means this system is suitable for all types of skiers.

The damping system is manufactured of light metal or plastic or of other materials in the following variants.

7.1 Damping Effect By Way Of Spring And Air Cylinder (see FIGS. 17, 19, 20, 21)

This embodiment is realized with the construction type THP (see FIG. 1).

The front and rear fastening include two tubes which in size are selected so that they may be inserted into one another. Within the tubes there is installed a compression spring for the damping. The damping system may be equipped with a pressure adjustment. In order to counteract a recoil effect there is a valve which lets the air within the tube quickly exit and ensures that the air with the unloading may only slowly flow into the tubes. This effect may however also take place via an expansion vessel which functions with air or oil. The height adjustment is effected via height arresting screws.

On the ski binding assembly plate and on the fastening tabs on the ski the tubes with a bolt or a screw or a quick closure are arrested so that they may slightly incline. For this purpose there is a slight milling on the tubes. One of the four pivots must be defined as a fixed point in that one does not envisage a milling for the inclining.

7.2 Damping Effect By Way Of Hinges And Leg Springs Or Compression Springs (see FIG. 18)

This embodiment is realized with the construction type THP (see FIG. 1).

The front fastening includes hinges which are arranged such that a fixed point D and a pivot A may be ensured. The rear fastening consists of hinges which are arranged on the ski and on the ski binding assembly plate such that additionally to the pivots B and C there arises a free pivot. The resiliency is made possible with the help of leg springs or compression springs in the hinges or between the ski and the ski binding assembly plate.

In order to counteract a propelling-back effect an expansion vessel may be used which functions with air or oil or a shock absorber.

The height adjustment is effected via height arresting screws.

7.3 Damping Effect With 4 Compression Springs (see FIGS. 22, 23, 24)

This embodiment is realized with the construction type (LCC) (see FIG. 2).

The fastening of ski binding assembly plate and ski are effected as described with the height adjustment (see FIGS. 22, 23, 24).

The 5.9 height adjustment is by way of a length compensation carriage.

The 5.10 height adjustment is by way of rigid fastening and steel screws.

The 5.11 height adjustment is by way of a length compensation carriage and plastic screws.

The 5.12 height adjustment is by way of a rigid fastening and plastic screws.

The screws however have a shank which in the length compensation carriage or in the rigid fastening are mounted so that a travel is permitted. The screws are equipped with compression springs. In order to counteract a jamming in the travel, additionally hinges or pantographs transverse to the skiing direction are applied.

In order to counteract a propelling-back effect an expansion vessel may be applied which functions with air or oil, or a shock absorber.

The height adjustment is effected via height adjusting screws.

7.4 Damping Effect With Pantograph

This embodiment is realized with the construction type RSP (see FIG. 1).

The fastening at the front and rear on the ski is effected with in each case one pantograph which is installed transverse to the skiing direction so that a fixed point and 3 rotational points are ensured. These two pantographs are equipped with compression and tension springs. In order to counteract a recoil effect an expansion vessel may be used which functions with air or oil, or a shock absorber.

The height adjustment is effected via height adjusting screws.

EMBODIMENT EXAMPLES

1st Example

The ski binding assembly plate is fixed or adjustable in height, in inclination and in length and has a two-point support and arrest system. Additionally it may be equipped with a force transmission system or travel multiplication system or with a wedge function or a height adjustment system or inclination angle adjusting system or a damping system or in combinations with the various systems. It is manufactured of light metal or plastic profiles or profiles of other materials (rectangular tube, U-profile, C-profile) which may be adhered above and below as a reinforcement to a steel plate, plastic plate or other materials. It may also be manufactured in cast molds with light metal or other materials.

It is manufactured in the construction type THP (tubes, hinges or pantograph). (see FIG. 1)

This construction type is constructed with rods or hinges of light metal or plastic or other materials in that a fixed pont (D) and three pivots (A,B,C) are applied. These pivots (A,B,C) permit a length compensation. The fixed point (D) serves for fixing the ski binding assembly plate. The fixed point may be defined at any point (A,B,C,D) according to use.

This can also be realized with construction type LCC (length compensation carriage) (see FIG. 2).

The construction type includes the application of a length compensation carriage which is applied in the ski binding assembly plate according to the construction type, at the front or the rear. The length compensation carriage reacts to force actions which only act on the ski at the front, as well as force actions which only act on the ski at the rear, as well as to force actions which act at the front as well as the rear. This length compensation is the basis for realizing the wedge function. It is manufactured in light metal or in other materials.

2nd Example

The ski binding assembly plate has a two-point support and arrest system. The two point support and arrest system gives the ski a free bending moment. This means that the ski has on its whole length, also in the region of the binding the possibility of freely deflecting. "Two-point" indicates the support at the front and rear on the ski at which the ski binding assembly plate is fastened by way of a length compensation carriage and via a rigid fastening, and not the assembly points of the plate, whose number may be varied according to the construction type.

The Two-Point Support And Arrest System Is Realized With The Construction Type LCC. (see FIG. 2)

This embodiment is manufactured with a length compensation carriage with steel screws. (see FIG. 22). The steel screws for fastening the ski binding assembly pate on the ski are mounted with two aluminium or steel platelets or other materials which may move in the axial direction. These platelets are guided over aluminium or steel carriers or other materials, by way of two axles, on rollers.

On the counter side of the length compensation carriage on the ski binding assembly plate at the front and rear there is a rigid fastening with steel screws which are attached such that they via a movable plate yield to the bending moment of the ski. (see FIG. 24)

The two-point support and arrest system can be manufactured with a length compensation carriage with plastic screws. (See FIG. 23)

The plastic screws for fastening the ski binding assembly plate on the ski permit, because of their elasticity, for the length compensation carriage in inclination to be adapted to the bending moment. For obtaining the strength larger screws are used.

On the counter side of the length compensation carriage on the ski guide pressure intensifier plate at the front and rear there is a rigid fastening with plastic screws or an intensifier plate. (see FIG. 24)

By way of the fastening of the ski binding assembly plate with plastic screws at the front and rear on the ski, the bending moment of the ski is possible. The fastening screws may be exchanged in all fastenings, according to the height adjustment.

The Two-Point Support And Arrest System Is Also Realized With The Construction Type THP. (See FIG. 1)

This construction type is manufactured in light metal or plastic or in other materials in the following variants.

Height Adjustment With Bolts (see FIG. 11)

The front and the rear fastening consists of two tubes which have various height adjusting holes so that they may be arrested into one another, at various positions by way of a height adjusting bolt.

Height Adjustment With Thread (see FIG. 12)

The front and the rear fastening includes two tubes which on one side may have a fine thread so that they may be screwed into one another. The arresting on the ski binding assembly plate and on the ski is simultaneously the height arresting in that the tubes with the threads may no longer be rotated.

Height Adjustment With A Rotation Disk (see FIG. 13)

With this embodiment there is a tube with an outer thread. In the ski binding assembly plate there is attached a rotation disk with an inner thread such that this may be rotated for the height adjustment.

Height Adjustment With A Rotation Knob (see FIG. 14)

This embodiment differs from the embodiment of height adjustment with a rotation disk because the rotation disk for the height adjustment is exchanged with a rotation knob which is fastened in the ski binding assembly plate with a circlip.

Height Adjustment With A Rotation Knob (see FIG. 15)

This embodiment differs from the embodiment of height adjustment with rotation knob, (see FIG. 14), because the rotation knob is fastened within the ski binding assembly plate with a circlip. The rotation knob is arrested via an eccentric. The fastening on the ski is attached on the inside on the tube.

The arresting on the ski is effected with tabs, as in the height adjustment with bolts (see FIG. 11), or with a fastening block which is on the inside on the tube (see FIG. 12) or with a round flange (see FIG. 13), and bolts or screws or a quick closure so that the tubes may slightly incline. For this purpose there is a slight milling on the tubes. The fixed point is defined in that one does not provide a milling on the tubes for the inclining.

Height Adjustment By Way Of Hinges (see FIG. 16)

The front and the rear fastenings include hinges of light metal or other materials which are fastened on the ski binding assembly plate and on the ski such that these and various height adjusting holes may be screwed together at various positions. The definition of the fixed point is effected via the fastening at an angle.

Height Adjustment With Hinges And Damping Effect By Way Of Leg Or Compression Springs (see FIG. 18)

The hinges are arranged such that the ski binding assembly plate may move in height. The height adjustment is effected via a height arresting screw.

3rd Example

With the ski binding assembly plate the guide pressure point FD1 lies in the region of 25 cm to 50 cm, measured from the assembly point in the middle of the ski shoe up to the rear guide pressure point FD2. (see FIG. 35)

4th Example

The ski binding assembly plate is equipped with a force transmission system. (see FIG. 32)

The free bending moment is ensured by way of the force transmission function because the force action F6 according to the curve via a pivot according to the lever principle is converted into a resulting force F5 which lifts the counter pressure F4. The length of the force transmission tabs is on account of the force ratio defined according to the lever principle. With an adjusting screw the height is adjusted and a fine adaptation of the ski is carried out. (see FIG. 33, force transmission function)

This system effects additionally to the free bending moment, less vibration and thus a better grip, particularly on hard snow.

The force transmission tabs are manufactured in light metal or plastic or other materials and rigidly screwed on the front part or rear part of the ski. A plastic U-disk ensures a slight bending moment. By way of the bending moment of the ski between the tab and the ski there arises a length distance of up to 2 mm. This length compensation is milled in the tabs by way of longitudinal grooves in the direction of the middle of the ski. The fastening is effected with special flat head shank screws and a plastic U-disk in order to ensure a slight bending moment and a smaller friction for the length compensation. Instead of the plastic U-disk the friction may be lifted with a roller which runs in a groove transversely to the length compensation. (see FIG. 32, force transmission system)

5th Example

Figure 28:
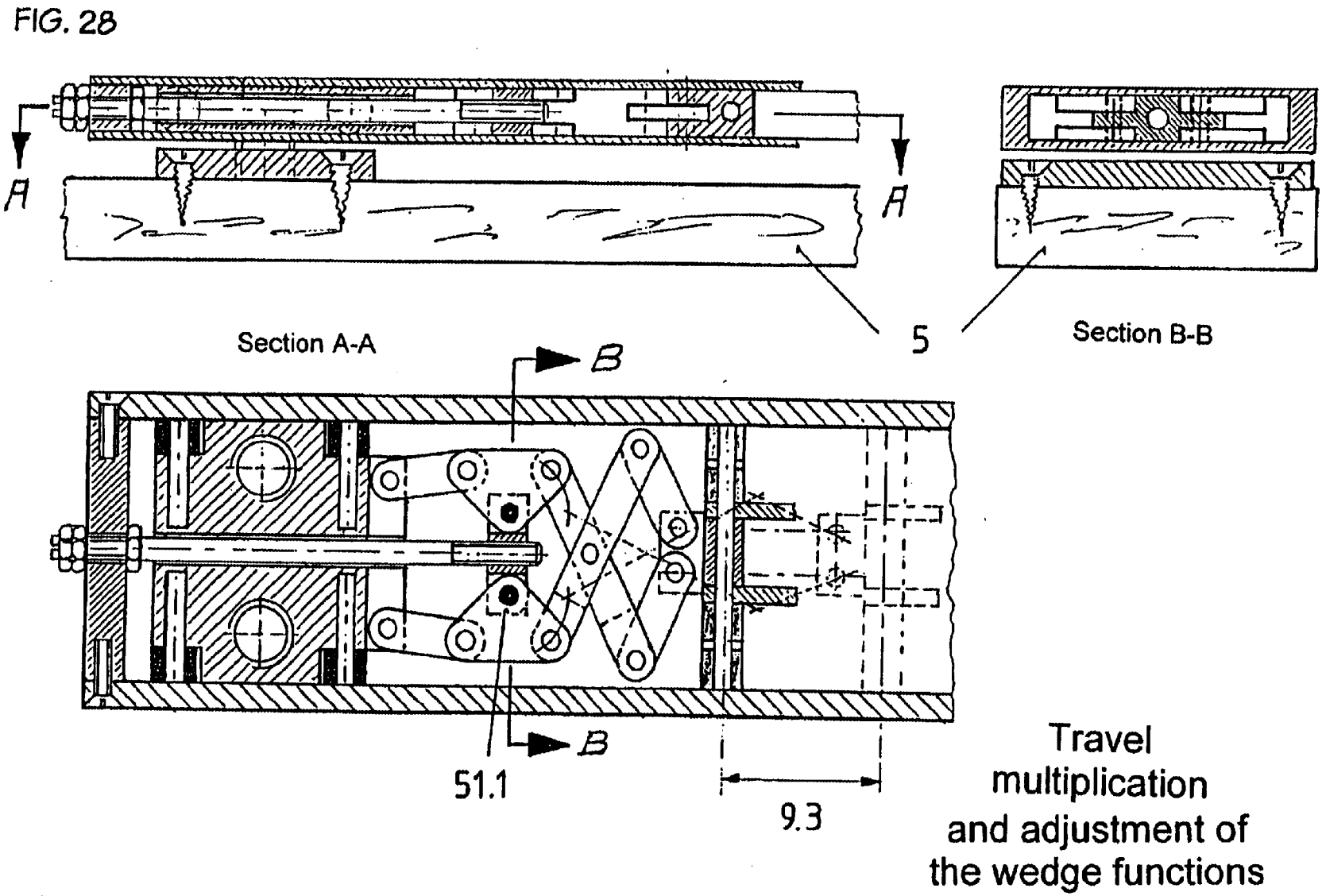
FIG. 28 shows a side sectional view, a front sectional view and a top sectional view of a travel multiplication and adjustment apparatus for wedge functions.

The ski binding assembly plate has a travel multiplication in the following construction type: (see FIGS. 28, 30, 31).

The travel multiplication multiplies the reaction force of the length compensation carriage from maximum 8 mm to a travel of approximately 30 mm. According to the construction type of the wedge function this is converted into a co-running or counter-running direction. It may according to the requirement of the wedge function be assembled at various positions in the plate. The force transmission is effected via light metal tabs or tabs 70 manufactured of other materials which are arranged according to the lever principle.

Travel Multiplication With A Gearwheel Gear

This embodiment is manufactured with a gearwheel gear.

The force transmission is transmitted via a gearwheel gear with a rack of plastic or other materials.

Travel Multiplication With A Tension Or Compression Spring

In order to counteract the inertia of the entire system of the ski, on the force transmission lever a tension or compression spring may be placed.

Travel Multiplication With An Implemented Wedge

In the travel multiplication there is co-implemented a wedge function of light metal or other materials in order to prevent a propelling-back of the forces. This is necessary for the application of a pantograph of light metal or other materials.

6th Example

Figure 34:
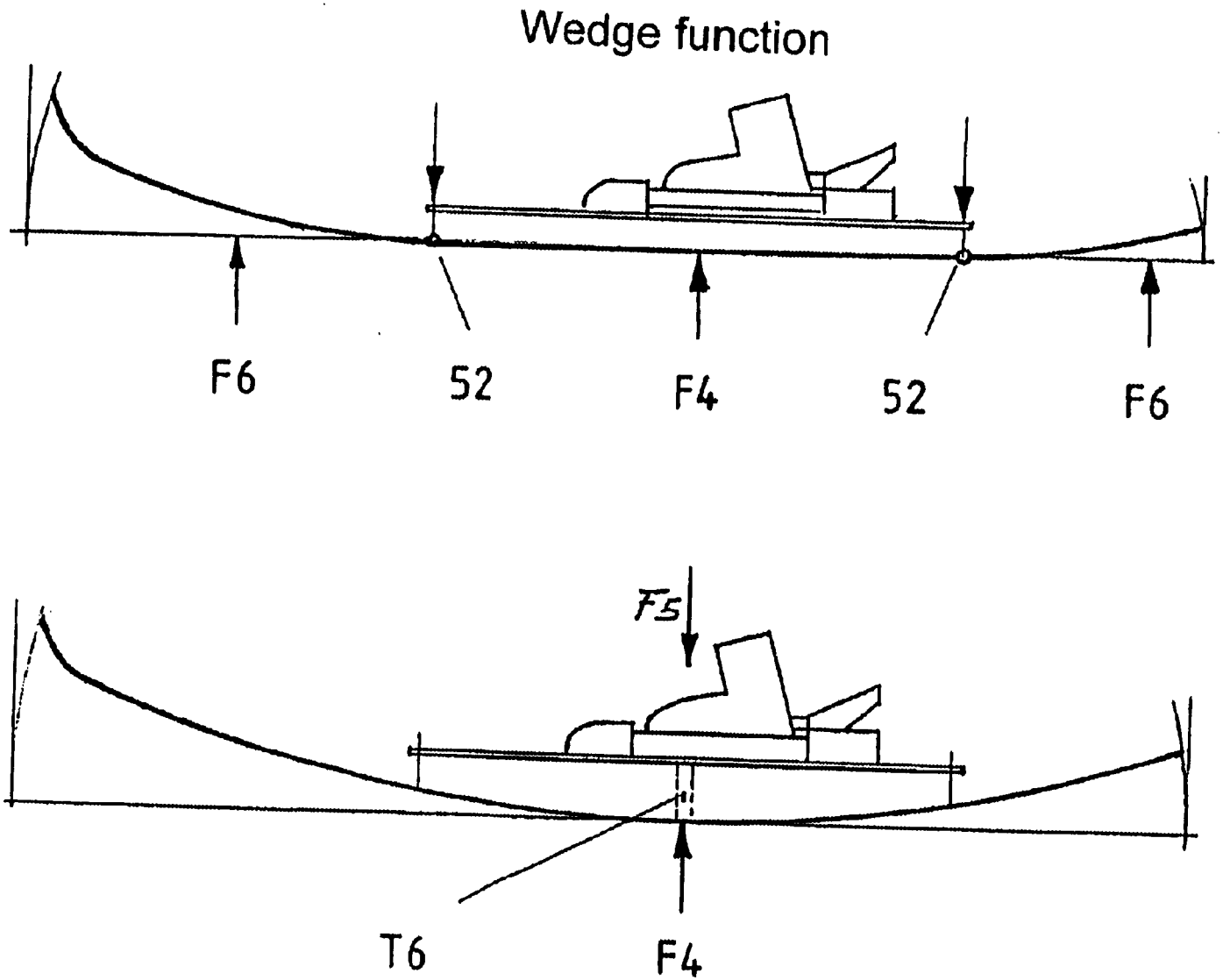
FIG. 34 shows a schematic diagram of a wedge function.

The ski binding assembly plate has a wedge function (see FIG. 34).

The wedge function lifts the unfavorable bending moment which arises by way of the counter pressure F4. The initial point is the length compensation carriage which reacts to the smallest force action F6 according to the curve (reaction path up to approximately 8 mm). This path of 1–8 mm is multiplied via the travel multiplication to maximum 30 mm. The 30 mm correspond to the maximum required wedge movement. The wedge has an inclination of 15 degrees and thus a good precondition for the force transmission onto the adjusting screw. This is required for the height adjustment and for a fine adaptation of the ski.

Oppositely, the counter force F4 acts from the ground or the snow at an angle of 75 degrees onto the wedge and is thus not in the position of influencing the wedge. Thus the propelling-back force is eliminated. The free bending moment is ensured by the wedge which extends out the adjusting screw according to the radius of the ski. This means no vibration and thus an improved grip particularly on hard snow.

According to the use various construction types in light metal and plastic or other materials are used.

Wedge Variant 1 (see FIG. 25)

The travel of maximum 30 mm is assumed by the travel multiplication and transferred to a carriage with rollers on which, on both sides there is milled a wedge of 15 degrees. This carriage is manufactured of light metal or plastic or other materials. The adjusting screw is extended via a lever arm of light metal or plastic or other materials, which from the wedge via a roller is actuated and fastened on the ski binding assembly plate via a joint. The extending travel is defined via the length of the lever arm, according to the lever principle.

Wedge Variant 2 (see FIG. 26)

The travel of maximum 30 mm is transferred by the travel multiplication onto a wedge of light metal or another material which is guided on rollers. This actuates a roller which is incorporated in a round profile of light metal or another material. The round profile is screwed into a connection plate of light metal or another material which via pressed-in sleeves, of light metal or other materials, actuate the adjusting screw. The sleeves of light metal or of other materials run in plastic bearings which are pressed in the ski binding assembly plate.

Wedge Variant 3 (see FIG. 27)

The travel of maximum 30 mm is transferred by the travel multiplication onto two wedges of light metal or other materials which are guided on rollers. These actuate rollers which by way of a U-profile of light metal or other materials are connected to one another below the ski binding assembly plate. Via this U-profile there are actuated the adjusting screws which are assembled in sleeves of light metal or other material. These sleeves run in plastic bearings which are pressed in the ski binding assembly plate. The adjusting screws with the wedge variant 2 and the wedge variant 3 in the idle condition may not project more that 15 mm from the ski binding assembly plate, otherwise they contact the ski shoe. Thus the travel is limited to approximately 12 mm. The wedge path must be cut out in the upper wall of the ski binding assembly plate. This is done away with when one selects a higher profile. Then also a greater travel may be ensured.

7th Example

The ski binding assembly plate is equipped with a height adjustment (see FIG. 1).

The height adjustment is manufactured of light metal or plastic or in other materials in the following variants.

Height Adjustment With Bolts (see FIG. 11)

This variant is realized with the construction type THP (see FIG. 1).

The front and the rear fastening include two tubes which have various height adjusting holes so that they may be arrested into one another, at various positions by way of a height adjusting bolt.

Height Adjustment With A Thread (see FIG. 12)

This variant is realized with the construction type THP (see FIG. 1).

The front and the rear fastening includes two tubes which on one side may have a fine thread so that they may be screwed into one another. The arresting on the ski binding assembly plate and on the ski is at the same time the height arresting in that the tubes with the threads may no longer be rotated.

Height Adjustment With A Rotation Disk (see FIG. 13)

This variant is realized with the construction type THP (see FIG. 1).

With this variant there is a tube with an outer thread. In the ski binding assembly plate there is attached a rotation disk with an inner thread such that this may be rotated for the height adjustment.

Height Adjustment With A Rotation Knob (see FIG. 14)

This variant is realized with the construction type THP (see FIG. 1).

This variant differs from the variant height adjustment with a rotation disk (see FIG. 9) because the rotation disk for the height adjustment is exchanged with a rotation knob which is fastened in the ski binding assembly plate with a circlip.

Height Adjustment With A Rotation Knob (see FIG. 15)

This variant is realized with the construction type THP (see FIG. 1).

This variant differs from the variant height adjustment with rotation knob, (see FIG. 14) because the rotation knob is fastened within the ski binding assembly plate with a circlip. The rotation knob is arrested via an eccentric. The fastening on the ski is attached on the inside on the tube.

FIGS. 19, 20, 21 show variants in which the spring pressure may be adjusted. Here the height adjustment is effected via a steel pin with which one limits the spring path.

Arresting On The Ski

The arresting on the ski is effected with tabs, as in the height adjustment with bolts (see FIG. 11), or with a fastening block which is on the inside on the tube (see FIG. 12) or with a round flange (see FIG. 13), and bolts or screws or a quick closure so that the tubes may slightly incline. For this purpose there is a slight milling on the tubes. The fixed point is defined in that one does not provide a milling on the tubes for the inclining.

Height Adjustment By Way Of Hinges (see FIG. 16)

This variant is realized with the construction type THP (see FIG. 1).

The front and the rear fastenings consist of hinges of light metal or other materials which are fastened on the ski binding assembly plate and on the ski such that these and various height adjusting holes may be screwed together at various positions. The definition of the fixed point is effected via the fastening with an angle.

Height Adjustment With Hinges And Damping Effect By Way Of Leg Or Compression springs (see FIG. 18)

This variant is realized with the constructional type THP (see FIG. 1).

The hinges are arranged such that the ski binding assembly plate may move in height. The height adjustment is effected via a height arresting screw.

Height Adjustment By Way Of A Length Compensation Carriage And Steel Screws (see FIG. 22)

This variant is realized with the construction type LCC (see FIG. 2).

The height adjustment of the ski binding assembly plate at the front or rear is effected via steel screws which are guided in a length compensation carriage over movable platelets of light metal and other materials and carriers on rollers. The fastening to the front and rear on the ski is effected via a fastening plate or with self-tapping insert bushings which are screwed directly in the ski and have an inner thread, or via force transmission tabs. (see FIG. 32 force transmission system).

Height Adjustment By Way Of A Rigid Fastening And Steel Screws (see FIG. 24)

This variant is realized with the construction type LCC (see FIG. 2).

On the counter side of the length compensation carriage on the ski binding assembly plate at the front or the rear there is effected a rigid fastening with steel screws which are attached such that via a movable plate they give way to the bending moment of the ski.

Height Adjustment By Way Way Of A Length Compensation Carriage And Plastic Screws (see FIG. 23)

This variant is realized with the construction type LCC (see FIG. 2).

The height adjustment of the ski assembly plate at the front and the rear is effected via plastic screws which have a slight elasticity and thus do not require a movable part in the length compensation carriage.

Height Adjustment By Way Of A Rigid Fastening And Plastic Screws (see FIG. 24)

This variant is realized with the construction type LCC (see FIG. 2).

On the counter side of the length compensation carriage, on the ski binding assembly plate at the front and rear there is effected a rigid fastening with plastic screws via a reinforcement plate.

The fastening of the ski binding assembly plate with plastic screws at the front and rear on the ski makes possible the bending moment of the ski.

fastening screws may in all fastenings be exchanged according to height adjustment.

8th Example

The ski binding assembly plate has an inclination angle adjustment. (see FIG. 5)

Inclination Angle Adjustment

The adjustment of the inclination is effected via the same mechanisms as described with the height adjustment. The ski binding assembly plate in the front part of the ski is adjusted lower.

9th Example

The ski binding assembly plate can have a damping effect. (see FIG. 6)

The damping system is manufactured of light metal or plastic or of other materials in the following variants.

Damping Effect By Way Of Spring And Air Cylinder (see FIGS. 17, 19, 20,21)

This variant is realized with the construction type THP (see FIG. 1).

The front and rear fastening includes two tubes which in size are selected such that they may be inserted into one another. Within the tubes there is installed a compression spring for the damping. The damping system may have a pressure adjustment. In order to counteract a recoil effect there is a valve which lets the air within the tube quickly exit and ensures that the air with the unloading may only slowly flow into the tubes. This effect may however also take place via an expansion vessel which functions with air or oil. The height adjustment is effected via height arresting screws.

On the ski binding assembly plate and on the fastening tabs on the ski the tubes with a bolt or a screw or a quick closure are arrested such that they may slightly incline. For this purpose there is a slight milling on the tubes. One of the four pivots must be defined as a fixed point in that one does not envisage a milling for the inclining.

Damping Effect By Way Of Hinges And Leg Springs Or Compression Springs (see FIG. 18)

This variant is realized with the construction type THP (see FIG. 1).

The front fastening includes hinges which are arranged such that a fixed point D and a pivot A may be ensured. The rear fastening includes hinges which are arranged on the ski and on the ski binding assembly plate such that additionally to the pivots B and C there arises a free pivot. The resiliency is made possible with leg springs or compression springs in the hinges or between the ski and the ski binding assembly plate.

In order to counteract a propelling-back effect an expansion vessel may be used which functions with air or oil or a shock absorber.

The height adjustment is effected via height arresting screws.

Damping Effect With 4 Compression Springs (see FIGS. 22, 23, 24)

This varient is realized with the construction type (LCC) (see FIG. 2).

The fastening of ski binding assembly plate and ski are effected as is described with the height adjustment: (see FIGS. 22, 23, 24).

The 5.9 height adjustment is by way of a length compensation carriage.

The 5.10 height adjustment is by way of rigid fastening and steel screws.

The 5.11 height adjustment by way of a length compensation carriage and plastic screws.

The 5.12 height adjustment is by way of a rigid fastening and plastic screws.

The screws however have a shank which in the length compensation carriage or in the rigid fastening are mounted such that a travel is permitted. The screws have compression springs. In order to counteract a jamming in the travel, additionally hinges or pantographs transverse to the skiing direction are applied.

In order to counteract a propelling-back effect an expansion vessel may be applied which functions with air or oil, or a shock absorber.

The height adjustment is effected via height adjusting screws.

Damping Effect With Pantograph

This variant is realized with the construction type RSP (see FIG. 1).

The fastening at the front and rear on the ski is effected with in each case one pantograph which is installed transverse to the skiing direction so that a fixed point and 3 rotational points are ensured. These two pantographs have compression and tension springs. In order to counteract a propelling-back effect an expansion vessel may be used which functions with air or oil, or a shock absorber.

The height adjustment is effected via height adjusting screws.

10th Example

The ski binding assembly plate is manufactured as a standard embodiment. (see FIGS. 7, 8)

This embodiment may not be adjusted in height and in inclination. It is manufactured according to use. In the world cup at present there is prescribed a 5.5 cm height from the lower edge of the ski to the lower edge of the ski shoe. For the carving region a higher version is considered. It is equipped with a two-point support and arrest system and a force compensation system. Additionally it may be equipped with a damping system.

It is equipped with or without length compensation rollers.

11th Example

A ski binding assembly plate is manufactured as an adjustable standard embodiment. (see FIGS. 1, 2)

This embodiment may be adjusted in height, in inclination and in length. It contains always a two-point support and arrest system, and according to use may be supplemented with a force transition system or a wedge function or in combination with both systems with a damping system.

12th Example

The ski binding assembly plate is manufactured as an embodiment integrated in the ski binding. (see FIGS. 9, 10)

This embodiment is the same as the standard embodiment or the adjustable embodiment, however it is integrated directly into the ski binding. The ski binding assembly plate is at the same time the guide rail for the adjustment of the ski binding.

13th Example

The ski binding assembly plate and the fastenings on the ski are manufactured of one piece in plastic or other materials or together with other materials. It is not meant that the ski binding assembly plate does not have several components such as for example height adjusting screws, length compensation carriage, etc., but that it with the arrest parts on the ski is a plastic cast part or a cast part of other materials.

14th Example

The ski binding assembly plate is manufactured as an embodiment for snow boards.

This embodiment is the same as the standard embodiment or the adjustable embodiment, however is adapted to the width of the snowboard.

This embodiment is the same as the standard embodiment or the adjustable embodiment but adapted to the width of the snowboard.

Important Points

A) pivot A

B) pivot B

C) pivot C

D) fixed point D

E) free pivot

Texts

T1 The length of the force transmission tabs is on account of the force ratio defined according to the lever principle.

T2 The free bending moment is ensured by way of the force transmission function.

T3 Unfavourable bending moment.

T4 The free bending moment is limited by the counter pressure F4.

T5 Unfavourable bending moment.

T6 Adjusting screw extended by way of the wedge.

T7 The free bending moment is ensured by way of the wedge which according to the deflection of the ski is extended according to the curve.

T8 Vibration-damping lever effect.

T9 Properties: improved ski guiding, less vibration, greater running smoothness.

Forces

FD1 front guide pressure point

FD2 rear guide pressure point

F3 intrinsic weight and centrifugal force F3 in the curve

F4 counter pressure

F5 resulting force F5 according to the lever principle, which lifts the counter pressure F4 according to the respective radius of the curve F6 force effect F6 according to the curve

What is claimed is:

1. In an interface device between a shoe and a ski sport apparatus, having a ski guide pressure intensifier plate for receiving the shoe, the ski guide pressure intensifier plate defining a plate plane and a longitudinal direction running in the plate plane, a first and a second fastening element which in the longitudinal direction are distanced from one another and each form a connection to the ski sport apparatus, a first connection between the first fastening element and the ski guide pressure intensifier plate, wherein the first connection contains a first joint, a second connection between the second fastening element and the ski guide pressure intensifier plate, wherein the second connection contains a second joint, and compensation means for compensating a distance change between the first and the second fastening element, the interface device comprising:

action means for forming external forces acting on the ski support apparatus that depend on a given bending of the ski sport apparatus and for maintaining largely intact a bending line of the ski sport apparatus below the ski guide pressure intensifier plate, independent of forces acting on the ski guide pressure intensifier plate and the ski sport apparatus.

2. In an interface device according to claim 1, wherein the action means comprise a travel multiplication.

3. In an interface device according to claim 1, wherein the action means transmit a bending moment from a ski sport apparatus region outside the ski guide pressure intensifier plate into the ski sport apparatus below the ski guide pressure intensifier plate.

4. In an interface device according to claim 1, wherein the ski sport apparatus is one of a ski and a snow board.

5. In an interface device according to claim 1, wherein the compensation means comprise a guide direction that is parallel to the longitudinal direction.

6. In an interface device according to claim 1, wherein a joint and the compensation means form a jointed guide.

7. In an interface device according to claim 1, wherein the compensation means comprise an additional joint which cooperates with one of the first joint and the second joint.

8. In an interface device according to claim 1, wherein at least one of the first joint and the second joint is one of a turning joint and an elastic joint.

9. In an interface device according to claim 1, wherein the first and second joints permit only rotations about axes parallel to a plate plane and perpendicular to the longitudinal direction.

10. In an interface device according to claim 1, wherein in a region of at least one of the fastening elements there is adjustment means for adjusting a height of the ski guide pressure intensifier plate.

11. In an interface device according to claim 1, wherein in a region of at least one of the fastening elements there is adjustment means for adjusting an inclination angle of the ski guide pressure intensifier plate with respect to the ski sport apparatus.

12. In an interface device according to claim 1, further comprising third adjustment means for adjusting a mutual distance of the fastening elements.

13. In an interface device according to claim 1, wherein in a region of at least one of the fastening elements there is one of a compression spring and a tension spring for forming a resiliency between the ski guide pressure intensifier plate and the ski sport apparatus.

14. In an interface device according to claim 1, wherein in a region of at least one of the fastening elements there is one of an air cylinder and an oil cylinder for forming a shock absorbing between the ski guide pressure intensifier plate and the ski sport apparatus.

15. In an interface device according to claim 1, wherein the ski pressure intensifier plate is one of fastened to a binding and is integrated into the binding.

16. In an interface device according to claim 1, wherein the ski guide pressure intensifier plate comprises a receiving region for receiving a ski shoe aligned in the longitudinal direction and the first fastening element lies at a distance of 25–50 cm, measured forwards in the longitudinal direction, from a middle of the receiving region, and the second fastening element at a distance of 25–40 cm, measured to the rear in the longitudinal direction, from the middle of the receiving region.

17. In an interface device according to claim 1, wherein the ski guide pressure intensifier plate and at least one of the fastening elements and the compensation means are manufactured as one piece.

18. In an interface device according to claim 1, wherein the interface device is used as a binding for the ski sport apparatus.

19. In an interface device according to claim 4, wherein at least one of the joints, the compensation means and the action means are intergrated in the ski sport apparatus.

20. In an interface device according to claim 4, wherein the action means comprise a region of the ski sport apparatus having one of a higher flexibility and a lower flexibility than another region of the ski sport apparatus.

21. In an interface device between a shoe and a ski sport apparatus, having a ski guide pressure intensifier plate for receiving the shoe, the ski guide pressure intensifier plate defining a plate plane and a longitudinal direction running in the plate plane, a first and a second fastening element which in the longitudinal direction are distanced from one another and each form a connection to the ski sport apparatus, a first connection between the first fastening element and the ski guide pressure intensifier plate, wherein the first connection contains a first joint, a second connection between the second fastening element and the ski guide pressure intensifier plate, wherein the second connection contains a second joint, and compensation means for compensating a distance change between the first and the second fastening element, the improvement comprising:

action means, which given a bending of the ski sport apparatus form external forces acting on the ski sport apparatus, for maintaining largely intact a bending line of the ski sport apparatus below the ski guide pressure intensifier plate, independent of forces acting on the ski guide pressure intensifier plate, the action means transmitting a turning moment from a ski sport apparatus region outside the ski guide pressure intensifier plate into the ski sport apparatus below the ski guide pressure intensifier plate, and the action means comprise at least one tab suitable for fastening in the longitudinal direction one of on and in the ski sport apparatus.

22. In an interface device according to claim 21, wherein the compensation means comprise a guide with a guide direction that is parallel to the longitudinal direction.

23. In an interface device according to claim 22, wherein a joint and the compensation means form a jointed guide.

24. In an interface device according to claim 23, wherein the compensation means comprise an additional joint which cooperates with one of the first joint and the second joint.

25. In an interface device according to claim 24, wherein at least one of the first joint and the second joint is one of a turning joint and an elastic joint.

26. In an interface device according to claim 25, wherein the first and second joints permit only rotations about axes parallel to a plate plane and perpendicular to the longitudinal direction.

27. In an interface device according to claim 26, wherein in a region of at least one of the fastening elements there is first adjustment means for adjusting a height of the ski guide pressure intensifier plate.

28. In an interface device according to claim 27, wherein in the region at least of one of the fastening elements there is a second adjustment means for adjusting an inclination angle of the ski guide pressure intensifier plate with respect to the ski sport apparatus.

29. In an interface device according to claim 28, further comprising third adjustment means for adjusting a mutual distance of the fastening elements.

30. In an interface device according to claim 29, wherein in the region of at least one of the fastening elements there is one of a compression spring and a tension spring for forming a resiliency between the ski guide pressure intensifier plate and the ski sport apparatus.

31. In an interface device according to claim 30, wherein in the region of at least one of the fastening elements there is one of an air cylinder and an oil cylinder for forming a shock absorbing between the ski guide pressure intensifier plate and the ski sport apparatus.

32. In an interface device according to claim 31, wherein the ski pressure intensifier plate is one of fastened to a binding and is integrated into the binding.

33. In an interface device according to claim 32, wherein the ski guide pressure intensifier plate comprises a receiving region for receiving a ski shoe aligned in the longitudinal direction and the first fastening element lies at a distance of 25-50 cm, measured forwards in the longitudinal direction, from a middle of the receiving region, and the second fastening element at a distance of 25–40 cm, measured to the rear in the longitudinal direction, from the middle of the receiving region.

34. In an interface device according to claim 33, wherein the ski guide pressure intensifier plate and at least one of the fastening elements and the compensation means are manufactured as one piece.

35. In an interface device between a shoe and a ski sport apparatus, having a ski guide pressure intensifier plate for receiving the shoe, the ski guide pressure intensifier plate defining a plate plane and a longitudinal direction running in the plate plane, a first and a second fastening element which in the longitudinal direction are distanced from one another and each form a connection to the ski sport apparatus, a first connection between the first fastening element and the ski guide pressure intensifier plate, wherein the first connection contains a first joint, a second connection between the second fastening element and the ski guide pressure intensifier plate, wherein the second connection contains a second joint, and compensation means for compensating a distance change between the first and the second fastening element, the improvement comprising:

action means, which given a bending of the ski sport apparatus form external forces acting on the ski sport apparatus, for maintaining largely intact a bending line of the ski sport apparatus below the ski guide pressure intensifier plate, independent of forces acting on the ski guide pressure intensifier plate, wherein the action means are integrated in the ski sport apparatus, the action means comprise at least one tab mounted in the ski sport apparatus in the longitudinal direction, and the ski sport apparatus is one of a ski and a snow board.

* * * * *

UNITED STATES PATENT AND TRADEMARK OFFICE

CERTIFICATE OF CORRECTION

PATENT NO. : 6,648,362 B1
DATED : November 18, 2003
INVENTOR(S) : Roland Bünter

It is certified that error appears in the above-identified patent and that said Letters Patent is hereby corrected as shown below:

Title page,
Item [22], PCT Filed, replace "Aug. 24, 2001" with -- Feb. 23, 2000 --

Signed and Sealed this

Fourth Day of May, 2004

JON W. DUDAS
*Acting Director of the United States Patent and Trademark Office*